US009128444B1

(12) United States Patent
Leemhuis et al.

(10) Patent No.: US 9,128,444 B1
(45) Date of Patent: Sep. 8, 2015

(54) TONER LEVEL SENSING FOR A REPLACEABLE UNIT OF AN IMAGE FORMING DEVICE USING PULSE WIDTH PATTERNS FROM A MAGNETIC SENSOR

(71) Applicant: Lexmark International, Inc., Lexington, KY (US)

(72) Inventors: Michael Craig Leemhuis, Nicholasville, KY (US); Charles Alan Bast, Winchester, KY (US)

(73) Assignee: Lexmark International, Inc., Lexington, KY (US)

( * ) Notice: Subject to any disclaimer, the term of this patent is extended or adjusted under 35 U.S.C. 154(b) by 0 days.

(21) Appl. No.: 14/254,178

(22) Filed: Apr. 16, 2014

(51) Int. Cl.
*G03G 15/08* (2006.01)
*G03G 15/00* (2006.01)

(52) U.S. Cl.
CPC ..... *G03G 15/556* (2013.01)

(58) Field of Classification Search
CPC ..... G03G 15/556
USPC ..... 399/27, 29, 30, 63
See application file for complete search history.

(56) References Cited

U.S. PATENT DOCUMENTS

| | | | |
|---|---|---|---|
| 4,506,804 | A | 3/1985 | Oka |
| 4,989,754 | A | 2/1991 | Grasso et al. |
| 5,111,247 | A | 5/1992 | Nichols |
| 5,216,462 | A | 6/1993 | Nakajima et al. |
| 5,237,372 | A | 8/1993 | Ishii et al. |
| 5,383,007 | A | 1/1995 | Kinoshita et al. |
| 5,436,704 | A | 7/1995 | Moon |
| 5,587,770 | A | 12/1996 | Jo et al. |
| 5,634,169 | A | 5/1997 | Barry et al. |
| 5,995,772 | A | 11/1999 | Barry et al. |
| 6,032,004 | A | 2/2000 | Mirabella, Jr. et al. |
| 6,100,601 | A | 8/2000 | Baker et al. |
| 6,246,841 | B1 | 6/2001 | Merrifield et al. |
| 6,336,015 | B1 | 1/2002 | Numagami |

(Continued)

FOREIGN PATENT DOCUMENTS

| | | | |
|---|---|---|---|
| JP | 2000155461 A | * | 6/2000 |
| JP | 2002-108086 A | | 4/2002 |

(Continued)

OTHER PUBLICATIONS

International Search Report and Written Opinion of the International Searching Authority for PCT Application No. PCT/US2013/075569 dated Apr. 23, 2014.

(Continued)

*Primary Examiner* — Susan Lee
(74) *Attorney, Agent, or Firm* — Justin M Tromp

(57) ABSTRACT

A method for estimating an amount of toner remaining in a reservoir of a replaceable unit for an image forming device according to one example embodiment includes measuring an amount of revolution of a shaft in the reservoir of the replaceable unit, decreasing an estimate of the amount of toner remaining in the reservoir based on the measured amount of revolution of the shaft, monitoring whether a pattern of widths of digital pulses generated from a magnetic sensor when the magnetic sensor senses a magnetic field of a magnet connected to a paddle mounted on the shaft in the reservoir when the paddle is near a lowest center of gravity of the paddle changes, and adjusting the estimate of the amount of toner remaining in the reservoir when the pattern of widths of digital pulses generated from the magnetic sensor changes.

13 Claims, 11 Drawing Sheets

(56) References Cited

U.S. PATENT DOCUMENTS

| | | | |
|---|---|---|---|
| 6,343,883 | B1 | 2/2002 | Tada et al. |
| 6,459,876 | B1 | 10/2002 | Buchanan et al. |
| 6,496,662 | B1 | 12/2002 | Buchanan et al. |
| 6,510,291 | B2 | 1/2003 | Campbell et al. |
| 6,546,213 | B2 | 4/2003 | Ito et al. |
| 6,580,881 | B2 | 6/2003 | Coriale et al. |
| 6,600,882 | B1 | 7/2003 | Applegate et al. |
| 6,654,569 | B2 | 11/2003 | Nozawa |
| 6,718,147 | B1 | 4/2004 | Carter et al. |
| 6,819,884 | B1 | 11/2004 | Carter et al. |
| 7,103,308 | B2 | 9/2006 | Wakana |
| 7,139,505 | B2 | 11/2006 | Askren et al. |
| 7,177,567 | B2 | 2/2007 | Miller |
| 7,187,876 | B2 | 3/2007 | Ito et al. |
| 7,231,153 | B2 | 6/2007 | May |
| 7,248,806 | B2 | 7/2007 | Askren et al. |
| 7,399,074 | B2 | 7/2008 | Aldrich et al. |
| 7,551,862 | B2 | 6/2009 | Tanaka et al. |
| 7,555,231 | B2 | 6/2009 | Etter et al. |
| 7,782,198 | B2 | 8/2010 | Crockett et al. |
| 8,208,836 | B2 | 6/2012 | Shimomura |
| 8,718,496 | B2 | 5/2014 | Barry et al. |
| 2001/0051051 | A1 | 12/2001 | Matsumoto |
| 2002/0091413 | A1 | 7/2002 | Cappa et al. |
| 2002/0168192 | A1 | 11/2002 | Surya et al. |
| 2006/0198643 | A1 | 9/2006 | Kimura et al. |
| 2006/0291910 | A1 | 12/2006 | Choi et al. |
| 2007/0196137 | A1 | 8/2007 | Hebner et al. |
| 2008/0226351 | A1 | 9/2008 | Dawson et al. |
| 2009/0185833 | A1 | 7/2009 | Shimomura |
| 2010/0202798 | A1 | 8/2010 | Suzuki et al. |
| 2010/0303484 | A1 | 12/2010 | Hogan et al. |
| 2011/0206391 | A1 | 8/2011 | Naruse |
| 2012/0045224 | A1 | 2/2012 | Amann et al. |
| 2012/0070162 | A1 | 3/2012 | Barry |
| 2012/0099900 | A1 | 4/2012 | Noguchi et al. |
| 2012/0170948 | A1 | 7/2012 | Kwon et al. |
| 2013/0004208 | A1 | 1/2013 | Shimomura |
| 2013/0039670 | A1 | 2/2013 | Hosoya et al. |
| 2013/0202275 | A1 | 8/2013 | Brown et al. |
| 2013/0257455 | A1 | 10/2013 | Ahne et al. |
| 2013/0343777 | A1 | 12/2013 | Amann et al. |
| 2014/0029960 | A1 | 1/2014 | Ahne et al. |
| 2014/0079438 | A1 | 3/2014 | Abler et al. |
| 2014/0105619 | A1 | 4/2014 | Elliott et al. |
| 2014/0105620 | A1 | 4/2014 | Elliott et al. |
| 2014/0105622 | A1 | 4/2014 | True et al. |
| 2014/0169806 | A1 | 6/2014 | Leemhuis et al. |
| 2014/0169807 | A1 | 6/2014 | Leemhuis et al. |
| 2014/0169808 | A1 | 6/2014 | Leemhuis et al. |
| 2014/0169810 | A1 | 6/2014 | Leemhuis et al. |

FOREIGN PATENT DOCUMENTS

| | | | |
|---|---|---|---|
| JP | 3351179 | B2 | 11/2002 |
| WO | 2012144324 | A1 | 10/2012 |

OTHER PUBLICATIONS

International Search Report and Written Opinion of the International Searching Authority for PCT Application No. PCT/US2013/075573 dated Apr. 23, 2014.

International Search Report and Written Opinion of the International Searching Authority for PCT Application No. PCT/US2013/075575 dated Apr. 16, 2014.

Prosecution history of U.S. Appl. No. 13/717,908 including Notice of Allowance dated Apr. 11, 2014.

Prosecution history of U.S. Appl. No. 13/717,923 including Non-Final Office Action dated Aug. 19, 2014.

U.S. Appl. No. 14/227,117, filed Mar. 27, 2014.

U.S. Appl. No. 14/227,131, filed Mar. 27, 2014.

U.S. Appl. No. 14/257,074, filed Apr. 21, 2014.

Prosecution history of U.S. Appl. No. 13/717,908 including Notice of Allowance dated Nov. 14, 2014.

Prosecution history of U.S. Appl. No. 13/013,457 including Non-Final Office Action dated Feb. 5, 2015.

Prosecution history of U.S. Appl. No. 13/717,923 including Notice of Allowance dated Jan. 30, 2015.

Prosecution history of U.S. Appl. No. 14/107,487 including Notice of Allowance dated Feb. 11, 2015.

Prosecution history of U.S. Appl. No. 13/717,908 including Non-Final Office Action dated Jul. 18, 2014.

Machine translation of JP 2002-108086A obtained on May 8, 2015.

Notice of Allowance mailed Apr. 1, 2015 for U.S. Appl. No. 14/227,117.

* cited by examiner

TONER LEVEL SENSING FOR A REPLACEABLE UNIT OF AN IMAGE FORMING DEVICE USING PULSE WIDTH PATTERNS FROM A MAGNETIC SENSOR

CROSS REFERENCES TO RELATED APPLICATIONS

None.

BACKGROUND

1. Field of the Disclosure

The present disclosure relates generally to image forming devices and more particularly to toner level sensing for a replaceable unit of an image forming device.

2. Description of the Related Art

During the electrophotographic printing process, an electrically charged rotating photoconductive drum is selectively exposed to a laser beam. The areas of the photoconductive drum exposed to the laser beam are discharged creating an electrostatic latent image of a page to be printed on the photoconductive drum. Toner particles are then electrostatically picked up by the latent image on the photoconductive drum creating a toned image on the drum. The toned image is transferred to the print media (e.g., paper) either directly by the photoconductive drum or indirectly by an intermediate transfer member. The toner is then fused to the media using heat and pressure to complete the print.

The image forming device's toner supply is typically stored in one or more replaceable units installed in the image forming device. As these replaceable units run out of toner, the units must be replaced or refilled in order to continue printing. As a result, it is desired to measure the amount of toner remaining in these units in order to warn the user that one of the replaceable units is near an empty state or to prevent printing after one of the units is empty in order to prevent damage to the image forming device. Accordingly, a system for measuring the amount of toner remaining in a replaceable unit of an image forming device is desired.

SUMMARY

A method for estimating an amount of toner remaining in a reservoir of a replaceable unit for an image forming device according to one example embodiment includes rotating a shaft positioned in the reservoir and measuring an amount of revolution of the shaft. A paddle mounted on the shaft and free to fall ahead of the rotation of the shaft is pushed by the rotation of the shaft. An estimate of the amount of toner remaining in the reservoir is decreased based on the measured amount of revolution of the shaft. A magnetic field of a magnet connected to the paddle is sensed by a first magnetic sensor when the paddle is near a lowest center of gravity of the paddle. A digital pulse having a width is generated in response to the sensing of the magnetic field of the magnet by the first magnetic sensor. The width is a function of a time duration of the first magnetic sensor sensing the magnetic field of the magnet. The method includes monitoring whether a pattern of widths of digital pulses generated in response to the sensing of the magnetic field of the magnet by the first magnetic sensor changes. The estimate of the amount of toner remaining in the reservoir is adjusted when the pattern of widths of digital pulses generated in response to the sensing of the magnetic field of the magnet by the first magnetic sensor changes.

An electrophotographic image forming device according to one example embodiment includes a drive motor and a replaceable unit. The replaceable unit includes a reservoir for storing toner, a rotatable shaft positioned within the reservoir, a paddle mounted on the shaft and free to fall ahead of the rotation of the shaft, a magnet connected to the paddle, and a drive element positioned to receive rotational force from the drive motor when the replaceable unit is installed in the image forming device and operatively connected to the shaft to rotate the shaft upon receiving the rotational force from the drive motor. A first magnetic sensor is positioned to sense a magnetic field of the magnet when the paddle passes near the lowest center of gravity of the paddle. The first magnetic sensor generates a digital pulse when the first magnetic sensor senses the magnetic field of the magnet. The width of each digital pulse is a function of a time duration of the first magnetic sensor sensing the magnetic field of the magnet. A processor in electronic communication with the sensor is programmed to measure an amount of revolution of the shaft, decrease an estimate of the amount of toner remaining in the reservoir based on the measured amount of revolution of the shaft, monitor whether a pattern of widths of digital pulses generated from the first magnetic sensor when the first magnetic sensor senses the magnetic field of the magnet changes, and adjust the estimate of the amount of toner remaining in the reservoir when the pattern of widths of digital pulses generated from the first magnetic sensor changes.

A controller for use with an image forming device for estimating an amount of toner remaining in a reservoir of a replaceable unit of the image forming device according to one example embodiment is programmed to measure an amount of revolution of a shaft in the reservoir of the replaceable unit, to decrease an estimate of the amount of toner remaining in the reservoir based on the measured amount of revolution of the shaft, to monitor whether a pattern of widths of digital pulses generated from a magnetic sensor when the magnetic sensor senses a magnetic field of a magnet connected to a paddle mounted on the shaft in the reservoir when the paddle is near a lowest center of gravity of the paddle changes, and to adjust the estimate of the amount of toner remaining in the reservoir when the pattern of widths of digital pulses generated from the magnetic sensor changes. The widths of the digital pulses are a function of a time duration of the magnetic sensor sensing the magnetic field of the magnet.

BRIEF DESCRIPTION OF THE DRAWINGS

The accompanying drawings incorporated in and forming a part of the specification, illustrate several aspects of the present disclosure, and together with the description serve to explain the principles of the present disclosure.

DETAILED DESCRIPTION

In the following description, reference is made to the accompanying drawings where like numerals represent like elements. The embodiments are described in sufficient detail to enable those skilled in the art to practice the present disclosure. It is to be understood that other embodiments may be utilized and that process, electrical, and mechanical changes, etc., may be made without departing from the scope of the present disclosure. Examples merely typify possible variations. Portions and features of some embodiments may be included in or substituted for those of others. The following description, therefore, is not to be taken in a limiting sense and the scope of the present disclosure is defined only by the appended claims and their equivalents.

Figure 1:
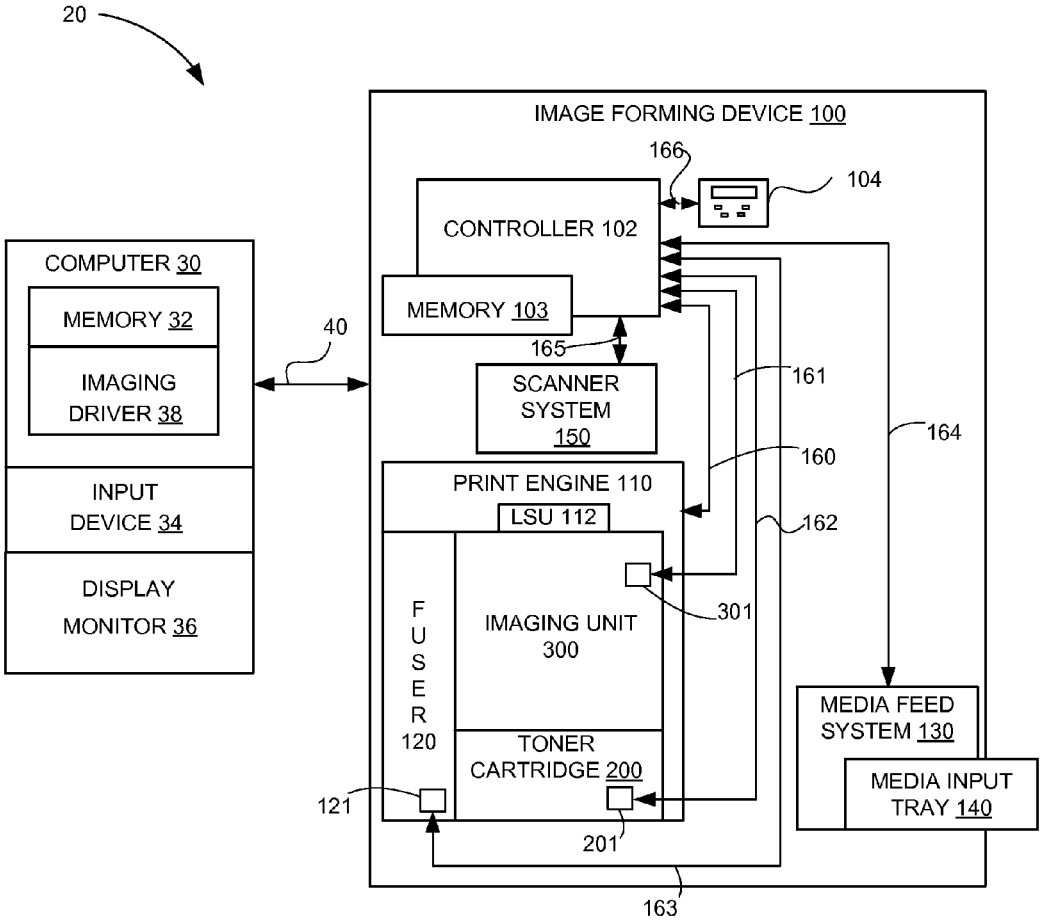
FIG. 1 is a block diagram depiction of an imaging system according to one example embodiment.

Referring now to the drawings and more particularly to FIG. 1, there is shown a block diagram depiction of an imaging system 20 according to one example embodiment. Imaging system 20 includes an image forming device 100 and a computer 30. Image forming device 100 communicates with computer 30 via a communications link 40. As used herein, the term "communications link" generally refers to any structure that facilitates electronic communication between multiple components and may operate using wired or wireless technology and may include communications over the Internet.

In the example embodiment shown in FIG. 1, image forming device 100 is a multifunction machine (sometimes referred to as an all-in-one (AIO) device) that includes a controller 102, a print engine 110, a laser scan unit (LSU) 112, one or more toner bottles or cartridges 200, one or more imaging units 300, a fuser 120, a user interface 104, a media feed system 130 and media input tray 140 and a scanner system 150. Image forming device 100 may communicate with computer 30 via a standard communication protocol, such as, for example, universal serial bus (USB), Ethernet or IEEE 802.xx. Image forming device 100 may be, for example, an electrophotographic printer/copier including an integrated scanner system 150 or a standalone electrophotographic printer.

Controller 102 includes a processor unit and associated memory 103 and may be formed as one or more Application Specific Integrated Circuits (ASICs). Memory 103 may be any volatile or non-volatile memory or combination thereof such as, for example, random access memory (RAM), read only memory (ROM), flash memory and/or non-volatile RAM (NVRAM). Alternatively, memory 103 may be in the form of a separate electronic memory (e.g., RAM, ROM, and/or NVRAM), a hard drive, a CD or DVD drive, or any memory device convenient for use with controller 102. Controller 102 may be, for example, a combined printer and scanner controller.

In the example embodiment illustrated, controller 102 communicates with print engine 110 via a communications link 160. Controller 102 communicates with imaging unit(s) 300 and processing circuitry 301 on each imaging unit 300 via communications link(s) 161. Controller 102 communicates with toner cartridge(s) 200 and processing circuitry 201 on each toner cartridge 200 via communications link(s) 162. Controller 102 communicates with fuser 120 and processing circuitry 121 thereon via a communications link 163. Controller 102 communicates with media feed system 130 via a communications link 164. Controller 102 communicates with scanner system 150 via a communications link 165. User interface 104 is communicatively coupled to controller 102 via a communications link 166. Processing circuitry 121, 201, 301 may each include a processor and associated memory such as RAM, ROM, and/or NVRAM and may provide authentication functions, safety and operational interlocks, operating parameters and usage information related to fuser 120, toner cartridge(s) 200 and imaging unit(s) 300, respectively. Processing circuitry 121, 201 and 301 may each include one or more ASICs. Controller 102 processes print and scan data and operates print engine 110 during printing and scanner system 150 during scanning.

Computer 30, which is optional, may be, for example, a personal computer, including memory 32, such as RAM, ROM, and/or NVRAM, an input device 34, such as a keyboard and/or a mouse, and a display monitor 36. Computer 30 also includes a processor, input/output (1/O) interfaces, and may include at least one mass data storage device, such as a hard drive, a CD-ROM and/or a DVD unit (not shown). Computer 30 may also be a device capable of communicating with image forming device 100 other than a personal computer such as, for example, a tablet computer, a smartphone, or other electronic device.

In the example embodiment illustrated, computer 30 includes in its memory a software program including program instructions that function as an imaging driver 38, e.g., printer/scanner driver software, for image forming device 100. Imaging driver 38 is in communication with controller 102 of image forming device 100 via communications link 40. Imaging driver 38 facilitates communication between image forming device 100 and computer 30. One aspect of imaging driver 38 may be, for example, to provide formatted print data to image forming device 100, and more particularly to print engine 110, to print an image. Another aspect of imaging driver 38 may be, for example, to facilitate the collection of scanned data from scanner system 150.

In some circumstances, it may be desirable to operate image forming device 100 in a standalone mode. In the standalone mode, image forming device 100 is capable of functioning without computer 30. Accordingly, all or a portion of imaging driver 38, or a similar driver, may be located in controller 102 of image forming device 100 so as to accommodate printing and/or scanning functionality when operating in the standalone mode.

Figure 2:
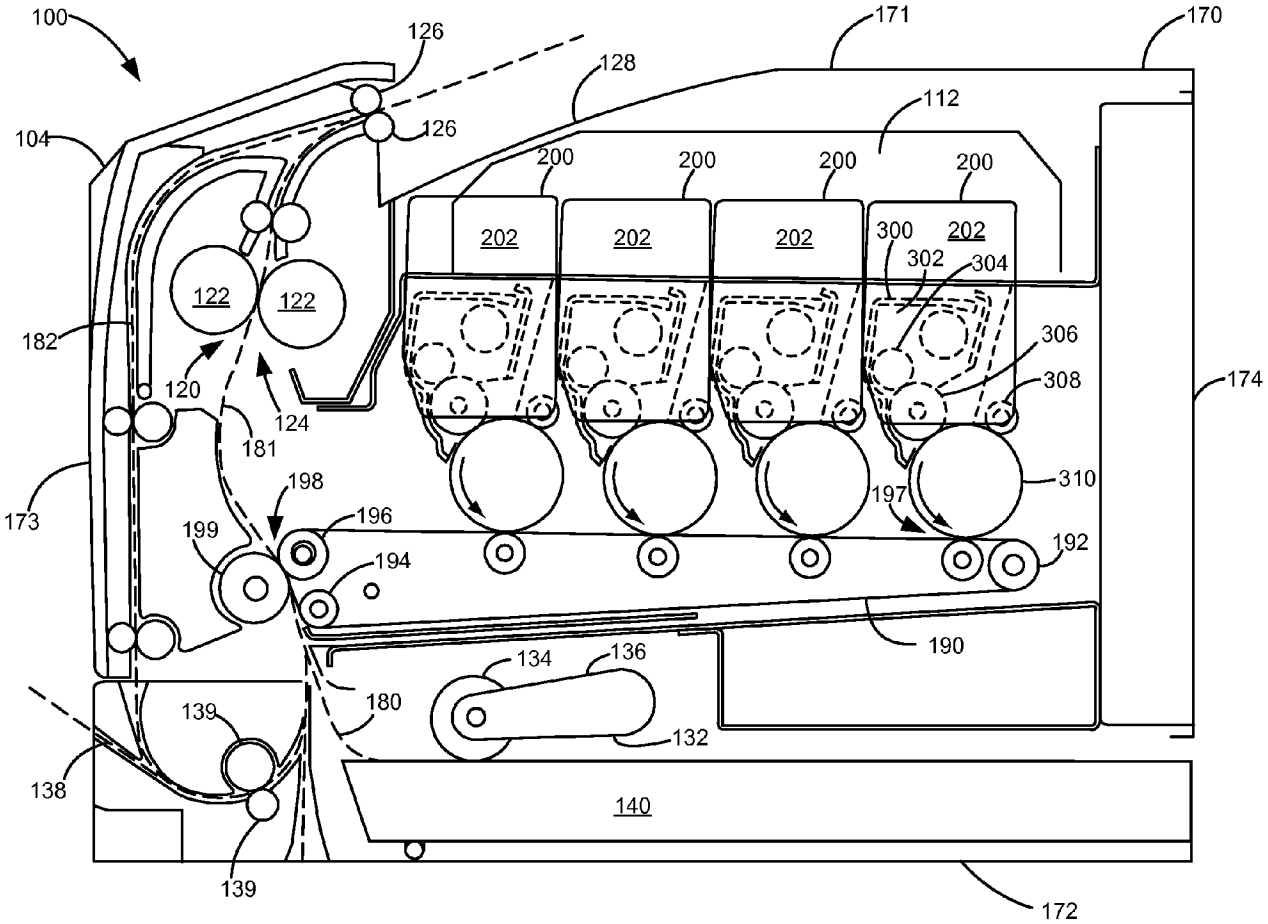
FIG. 2 is a schematic diagram of an image forming device according to a first example embodiment.

FIG. 2 illustrates a schematic view of the interior of an example image forming device 100. Image forming device 100 includes a housing 170 having a top 171, bottom 172, front 173 and rear 174. Housing 170 includes one or more media input trays 140 positioned therein. Trays 140 are sized to contain a stack of media sheets. As used herein, the term media is meant to encompass not only paper but also labels, envelopes, fabrics, photographic paper or any other desired substrate. Trays 140 are preferably removable for refilling. User interface 104 is shown positioned on housing 170. Using user interface 104, a user is able to enter commands and generally control the operation of the image forming device 100. For example, the user may enter commands to switch modes (e.g., color mode, monochrome mode), view the number of pages printed, etc. A media path 180 extends through image forming device 100 for moving the media sheets through the image transfer process. Media path 180 includes a simplex path 181 and may include a duplex path 182. A media sheet is introduced into simplex path 181 from tray 140 by a pick mechanism 132. In the example embodiment shown, pick mechanism 132 includes a roll 134 positioned at the end of a pivotable arm 136. Roll 134 rotates to move the media sheet from tray 140 and into media path 180. The media sheet is then moved along media path 180 by various transport rollers. Media sheets may also be introduced into media path 180 by a manual feed 138 having one or more rolls 139.

In the example embodiment shown, image forming device 100 includes four toner cartridges 200 removably mounted in housing 170 in a mating relationship with four corresponding imaging units 300 also removably mounted in housing 170. Each toner cartridge 200 includes a reservoir 202 for holding toner and an outlet port in communication with an inlet port of its corresponding imaging unit 300 for transferring toner from reservoir 202 to imaging unit 300. Toner is transferred periodically from a respective toner cartridge 200 to its corresponding imaging unit 300 in order to replenish the imaging unit 300. These periodic transfers are referred to as toner addition cycles and may occur during a print operation and/or between print operations. In the example embodiment illustrated, each toner cartridge 200 is substantially the same except for the color of toner contained therein. In one embodiment, the four toner cartridges 200 include yellow, cyan, magenta and black toner, respectively. Each imaging unit 300 includes a toner reservoir 302 and a toner adder roll 304 that moves toner from reservoir 302 to a developer roll 306. Each imaging unit 300 also includes a charging roll 308 and a photoconductive (PC) drum 310. PC drums 310 are mounted substantially parallel to each other when the imaging units 300 are installed in image forming device 100. For purposes of clarity, the components of only one of the imaging units 300 are labeled in FIG. 2. In the example embodiment illustrated, each imaging unit 300 is substantially the same except for the color of toner contained therein.

Each charging roll 308 forms a nip with the corresponding PC drum 310. During a print operation, charging roll 308 charges the surface of PC drum 310 to a specified voltage such as, for example, −1000 volts. A laser beam from LSU 112 is then directed to the surface of PC drum 310 and selectively discharges those areas it contacts to form a latent image. In one embodiment, areas on PC drum 310 illuminated by the laser beam are discharged to approximately −300 volts. Developer roll 306, which forms a nip with the corresponding PC drum 310, then transfers toner to PC drum 310 to form a toner image on PC drum 310. A metering device such as a doctor blade assembly can be used to meter toner onto developer roll 306 and apply a desired charge on the toner prior to its transfer to PC drum 310. The toner is attracted to the areas of the surface of PC drum 310 discharged by the laser beam from LSU 112.

An intermediate transfer mechanism (ITM) 190 is disposed adjacent to the PC drums 310. In this embodiment, ITM 190 is formed as an endless belt trained about a drive roll 192, a tension roll 194 and a back-up roll 196. During image forming operations, ITM 190 moves past PC drums 310 in a clockwise direction as viewed in FIG. 2. One or more of PC drums 310 apply toner images in their respective colors to ITM 190 at a first transfer nip 197. In one embodiment, a positive voltage field attracts the toner image from PC drums 310 to the surface of the moving ITM 190. ITM 190 rotates and collects the one or more toner images from PC drums 310 and then conveys the toner images to a media sheet at a second transfer nip 198 formed between a transfer roll 199 and ITM 190, which is supported by back-up roll 196.

A media sheet advancing through simplex path 181 receives the toner image from ITM 190 as it moves through the second transfer nip 198. The media sheet with the toner image is then moved along the media path 180 and into fuser 120. Fuser 120 includes fusing rolls or belts 122 that form a nip 124 to adhere the toner image to the media sheet. The fused media sheet then passes through exit rolls 126 located downstream from fuser 120. Exit rolls 126 may be rotated in either forward or reverse directions. In a forward direction, exit rolls 126 move the media sheet from simplex path 181 to an output area 128 on top 171 of image forming device 100. In a reverse direction, exit rolls 126 move the media sheet into duplex path 182 for image formation on a second side of the media sheet.

Figure 3:
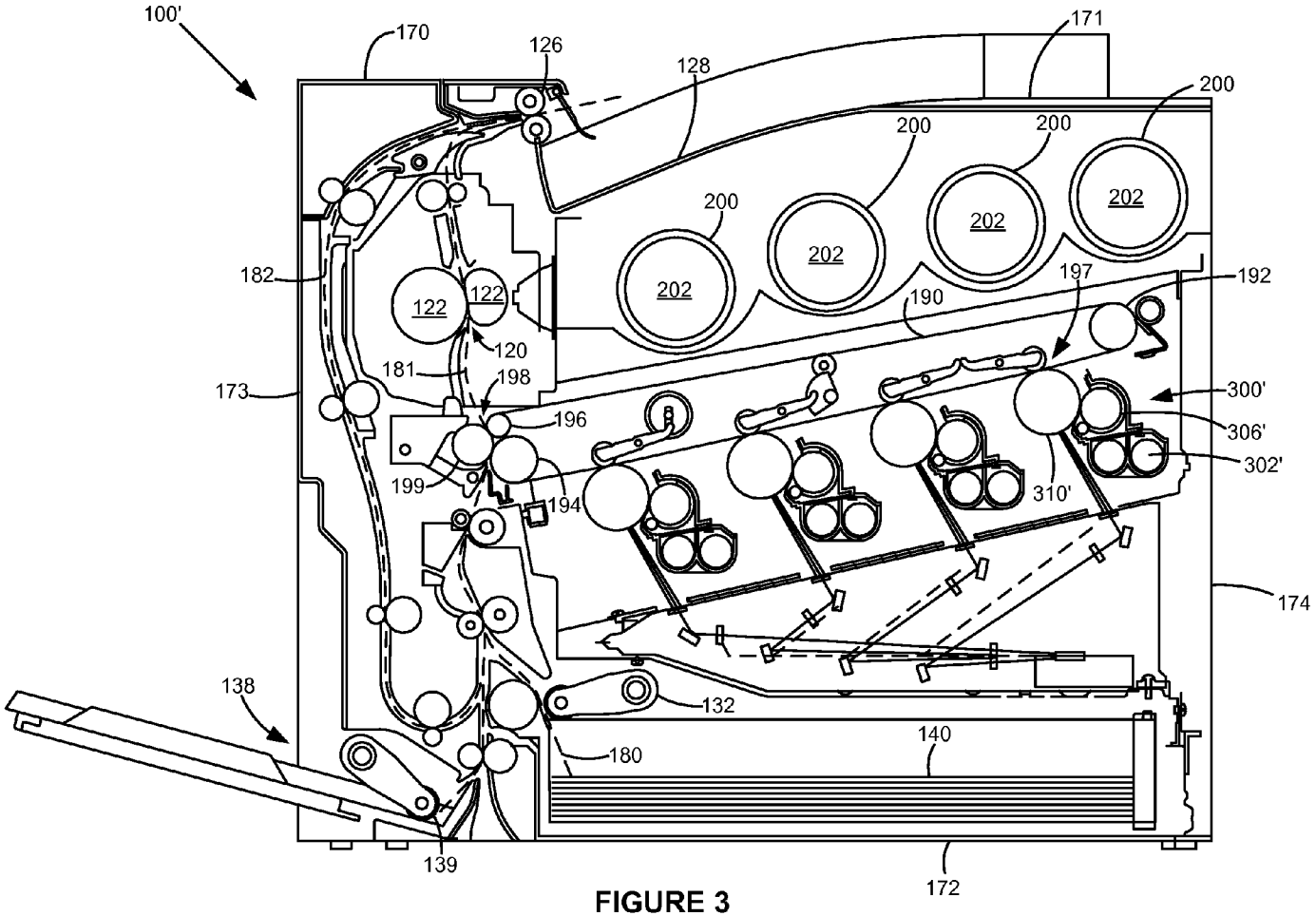
FIG. 3 is a schematic diagram of an image forming device according to a second example embodiment.

FIG. 3 illustrates an example embodiment of an image forming device 100' that utilizes what is commonly referred to as a dual component developer system. In this embodiment, image forming device 100' includes four toner cartridges 200 removably mounted in housing 170 and mated with four corresponding imaging units 300'. Toner is periodically transferred from reservoirs 202 of each toner cartridge 200 to corresponding reservoirs 302' of imaging units 300'. The toner in reservoirs 302' is mixed with magnetic carrier beads. The magnetic carrier beads may be coated with a polymeric film to provide triboelectric properties to attract toner to the carrier beads as the toner and the magnetic carrier beads are mixed in reservoir 302'. In this embodiment, each imaging unit 300' includes a magnetic roll 306' that attracts the magnetic carrier beads having toner thereon to magnetic roll 306' through the use of magnetic fields and transports the toner to the corresponding photoconductive drum 310'. Electrostatic forces from the latent image on the photoconductive drum 310' strip the toner from the magnetic carrier beads to provide a toned image on the surface of the photoconductive drum 310'. The toned image is then transferred to ITM 190 at first transfer nip 197 as discussed above.

While the example image forming devices 100 and 100' shown in FIGS. 2 and 3 illustrate four toner cartridges 200 and four corresponding imaging units 300, 300', it will be appreciated that a monocolor image forming device 100 or 100' may include a single toner cartridge 200 and corresponding imaging unit 300 or 300' as compared to a color image forming device 100 or 100' that may include multiple toner cartridges 200 and imaging units 300, 300'. Further, although image forming devices 100 and 100' utilize ITM 190 to transfer toner to the media, toner may be applied directly to the media by the one or more photoconductive drums 310, 310' as is known in the art.

Figure 4:
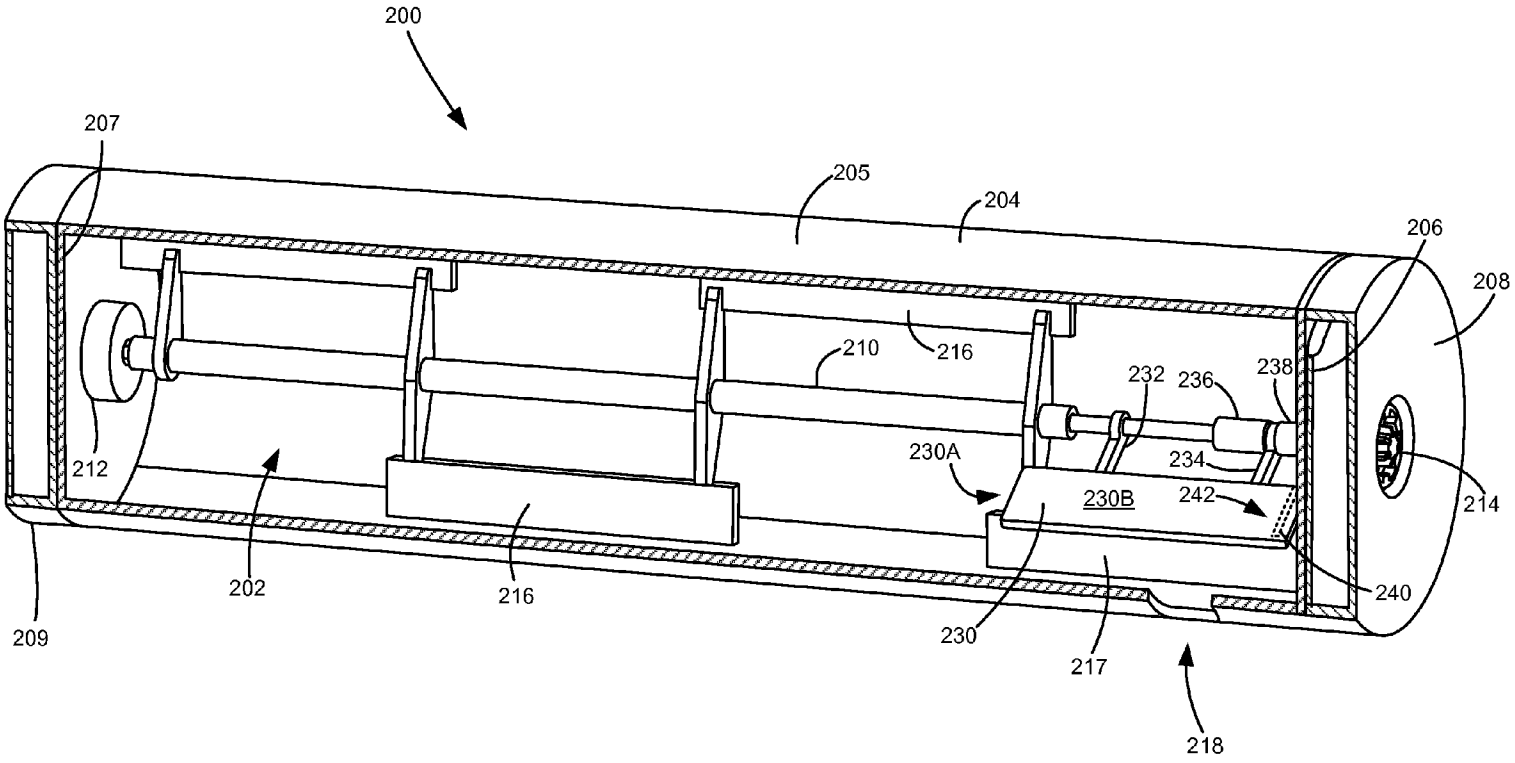
FIG. 4 is a perspective side view of a toner cartridge according to one example embodiment having a portion of a body of the toner cartridge removed to illustrate an internal toner reservoir.
Figure 5:
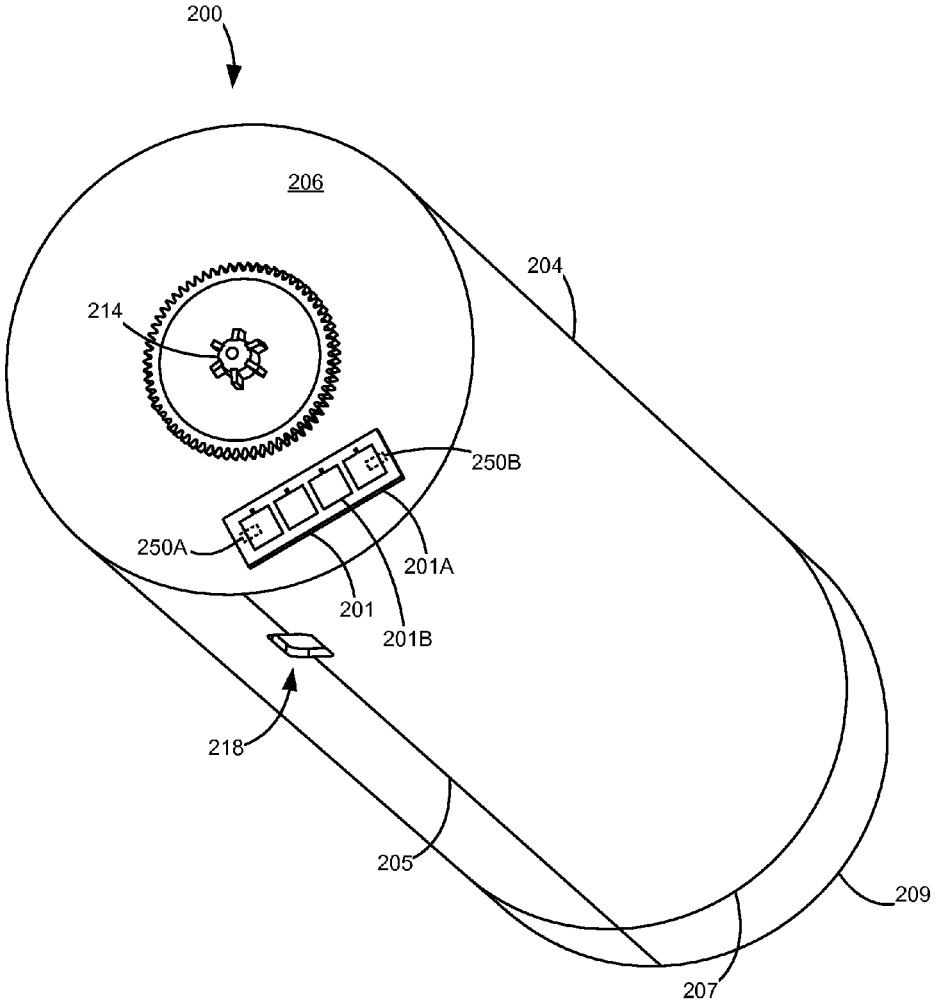
FIG. 5 is a perspective end view of the toner cartridge shown in FIG. 4.

With reference to FIGS. 4 and 5, toner cartridge 200 is shown according to one example embodiment. Toner cartridge 200 includes a body 204 that includes walls forming toner reservoir 202. In the example embodiment illustrated, body 204 includes a generally cylindrical wall 205 and a pair of end walls 206, 207. In this embodiment, end caps 208, 209 are mounted on end walls 206, 207, respectively, such as by suitable fasteners (e.g., screws, rivets, etc.) or by a snap-fit engagement. FIG. 4 shows toner cartridge 200 with a portion of body 204 removed to illustrate the internal components of toner cartridge 200. A rotatable shaft 210 extends along the length of toner cartridge 200 within toner reservoir 202. As desired, the ends of rotatable shaft 210 may be received in bushings or bearings 212 positioned on an inner surface of end walls 206, 207. A drive element 214, such as a gear or other form of drive coupler, is positioned on an outer surface of end wall 206. When toner cartridge 200 is installed in the image forming device, drive element 214 receives rotational force from a corresponding drive component in the image forming device to rotate shaft 210. Shaft 210 may be connected directly or by one or more intermediate gears to drive element 214. One or more agitators 216 (e.g., paddle(s), auger(s), etc.) may be mounted on and rotate with shaft 210 to stir and move toner within reservoir 202 as desired. In one embodiment, a flexible strip 220 (FIGS. 6A-6C), for example a polyethylene terephthalate (PET) material such as MYLAR® available from DuPont Teijin Films, Chester, Va., USA, may be connected to a distal end of agitator(s) 216 to sweep toner from the interior surface of one or more of walls 205, 206, 207.

An outlet port 218 is positioned on a bottom portion of body 204 such as near end wall 206. In the example embodiment shown, toner exiting reservoir 202 is moved directly into outlet port 218 by agitator(s) 216, which may be positioned to urge toner toward outlet port 218 in order to promote toner flow out of reservoir 202. In another embodiment, exiting toner is moved axially with respect to shaft 210 by a rotatable auger from an opening into reservoir 202, through a channel in wall 205 and out of outlet port 218. The rotatable auger may be connected directly or by one or more intermediate gears to drive element 214 in order to receive rotational force. Alternatively, the rotatable auger may be driven separately from shaft 210 using a second drive element to receive rotational force from the image forming device independently from shaft 210. As desired, outlet port 218 may include a shutter or a cover (not shown) that is movable between a closed position blocking outlet port 218 to prevent toner from flowing out of toner cartridge 200 and an open position permitting toner flow. Shaft 210 and the rotatable auger (if present) are rotated during each toner addition cycle to deliver toner from reservoir 202 through outlet port 218.

A paddle 230 is mounted on shaft 210 and is free to rotate on shaft 210. In other words, paddle 230 is rotatable independent of shaft 210. Paddle 230 is axially positioned next to end wall 206 but may be positioned elsewhere in reservoir 202 so long as a magnet 240 of paddle 230 is detectable by a magnetic sensor as discussed below. Paddle 230 is spaced from the interior surfaces of walls 205, 206, 207 so that walls 205, 206, 207 do not impede the motion of paddle 230. In the example embodiment illustrated, paddle 230 is axially positioned above the opening from outlet port 218 into reservoir 202 such that the rotational path of paddle 230 passes above the opening from outlet port 218 into reservoir 202. However, if the toner level for a particular design of reservoir 202 is substantially uniform, paddle 230 may be positioned elsewhere along shaft 210. Paddle 230 includes a pair of radial mounts 232, 234 each having an opening that receives shaft 210. Alternatively, paddle 230 may include one or more than two mounts. In the embodiment illustrated, stops 236, 238 are positioned on opposite axial sides of one or more of radial supports 232, 234 to limit the axial movement of paddle 230 along shaft 210.

Paddle 230 includes a magnet 240 that rotates with paddle 230 and has a magnetic field that is detectable by a magnetic sensor for determining an amount of toner remaining in reservoir 202 as discussed in greater detail below. In one embodiment, magnet 240 is positioned at an axially outermost portion of paddle 230 near end wall 206 in order to permit detection by a magnetic sensor on end wall 206 (either mounted directly on end wall 206 or indirectly on end wall 206, such as on end cap 208) or on a portion of the image forming device adjacent to end wall 206 when toner cartridge 200 is installed in the image forming device. In one embodiment, a pole of magnet 240 is directed toward the position of the magnetic sensor in order to facilitate the detection of magnet 240 by the magnetic sensor. The magnetic sensor may be configured to detect one of a north pole and a south pole of magnet 240 or both. Where the magnetic sensor detects one of a north pole and a south pole, magnet 240 may be positioned such that the detected pole is directed toward the magnetic sensor. In one embodiment, paddle 230 is composed of a non-magnetic material and magnet 240 is held by a friction fit in a cavity 242 in paddle 230. For example, paddle 230 may be formed of plastic overmolded around magnet 240. Magnet 240 may also be attached to paddle 230 using an adhesive or fastener(s) so long as magnet 240 will not dislodge from paddle 230 during operation of toner cartridge 200. Magnet 240 may be any suitable size and shape so as to be detectable by a magnetic sensor. For example, magnet 240 may be a cube, a rectangular, octagonal or other form of prism, a sphere or cylinder, a thin sheet or an amorphous object. In another embodiment, paddle 230 is composed of a magnetic material such that the body of paddle 230 forms the magnet 240. Magnet 240 may be composed of any suitable material such as steel, iron, nickel, etc. In one embodiment, body 204 and agitator 216 are composed of a non-magnetic material, such as plastic, so as not to attract magnet 240 and interfere with the motion of paddle 230.

Paddle 230 is axially aligned on shaft 210 with a driving member 217 mounted on shaft 210 such that paddle 230 is in the rotational path of driving member 217. In this manner, driving member 217 is able to push paddle 230 when shaft 210 rotates. In the example embodiment illustrated, an agitator 216 serves as driving member 217; however, a paddle or other form of extension from shaft 210 may serve as the driving member 217. In one embodiment, shaft 210 and driving member 217 rotate at a substantially constant rotational speed when driven by drive element 214. Driving member 217 pushes a rear surface 230A of paddle 230. Paddle 230 may include ribs or other predefined contact points on its rear surface 230A for engagement with driving member 217.

Figure 6A:
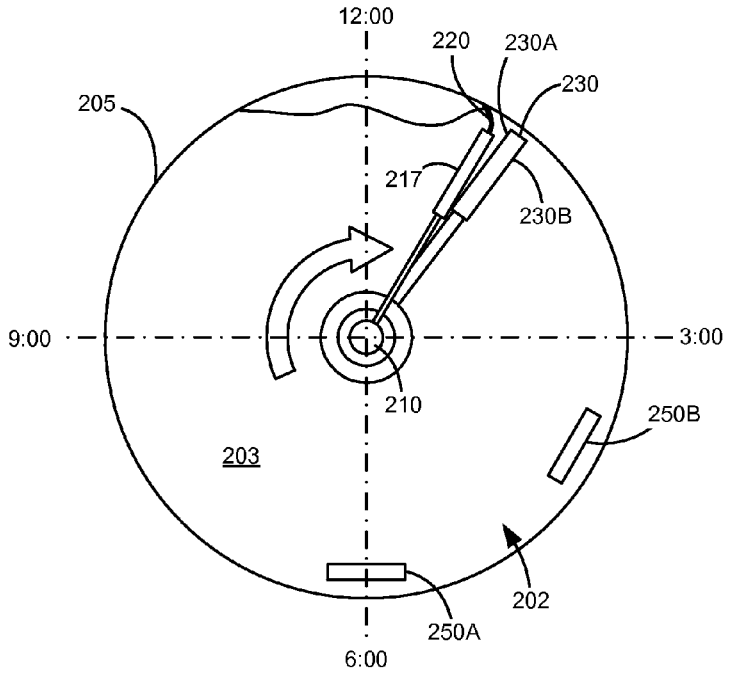
FIGS. 6A-C are schematic diagrams of a side view of the toner cartridge illustrating the operation of a falling paddle at various toner levels.
Figure 6B:
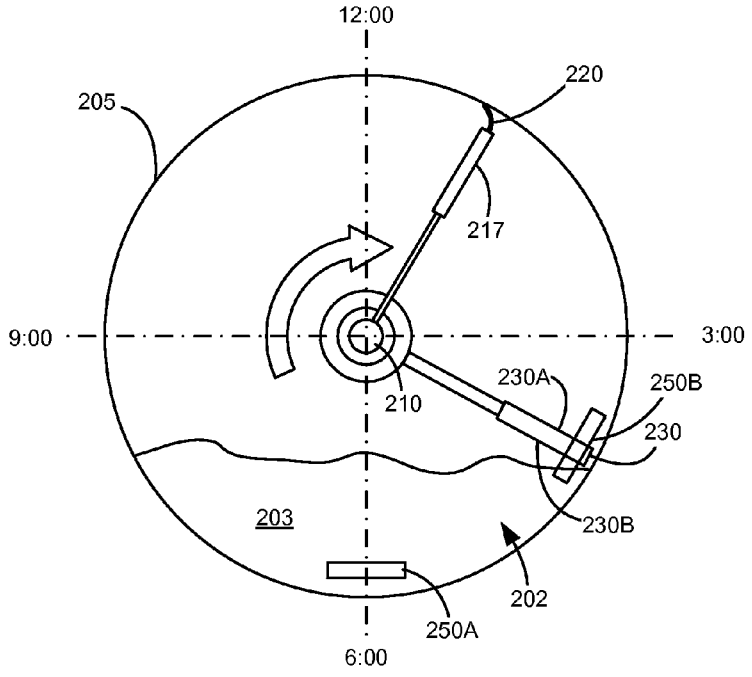
Figure 6C:
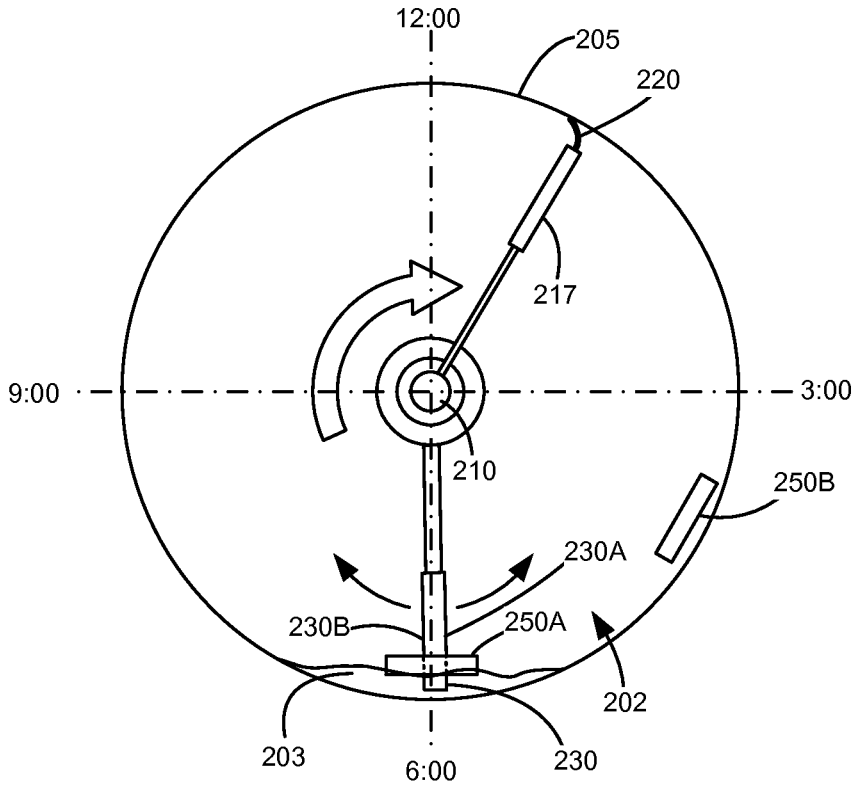

FIGS. 6A-6C schematically depict the relationship between paddle 230 and driving member 217. FIGS. 6A-6C depict a clock face in dashed lines along the rotational path of paddle 230 in order to aid in the description of the operation of paddle 230. When toner reservoir 202 is relatively full as depicted in FIG. 6A, toner 203 present in reservoir 202 prevents paddle 230 from rotating freely about shaft 210. Instead, paddle 230 is pushed through its rotational path by driving member 217 when shaft 210 rotates. As a result, when toner reservoir 202 is relatively full as shaft 210 rotates, the rotational motion of paddle 230 follows the rotational motion of driving member 217. Toner 203 prevents paddle 230 from advancing quicker than driving member 217.

As the toner level in reservoir 202 decreases as depicted in FIG. 6B, as paddle 230 is pushed through the upper vertical position of rotation (the "12 o'clock" position) by driving member 217, paddle 230 tends to separate from driving member 217 and fall faster (toward the "3 o'clock" position) than driving member 217 is being driven due to the weight of paddle 230. As a result, paddle 230 may be referred to as a falling paddle. Paddle 230 falls forward under its own weight until a front face 230B of paddle 230 contacts toner 203, which stops the rotational advance of paddle 230. In this manner, paddle 230 remains substantially stationary on top of (or slightly below the surface of) toner 203 until driving member 217 catches up with paddle 230. When driving member 217 advances and re-engages with rear surface 230A of paddle 230, driving member 217 resumes pushing paddle 230 through its rotational path.

When the toner level in reservoir 202 gets low as depicted in FIG. 6C, paddle 230 tends to fall forward away from driving member 217 as paddle passes the "12 o'clock" position and tends to swing all the way down to the lower vertical position of its rotational path (the "6 o'clock" position). Depending on how much toner 203 remains, paddle 230 may tend to oscillate back and forth in a pendulum manner about the "6 o'clock" position until driving member 217 catches up to resume pushing paddle 230. As a result, it will be appreciated that the rotational motion of paddle 230 relates to the amount of toner 203 remaining in reservoir 202. FIGS. 6A-6C show shaft 210 rotating in a clockwise direction when viewed from end wall 206; however, the direction of rotation may be reversed as desired.

Figure 7A:
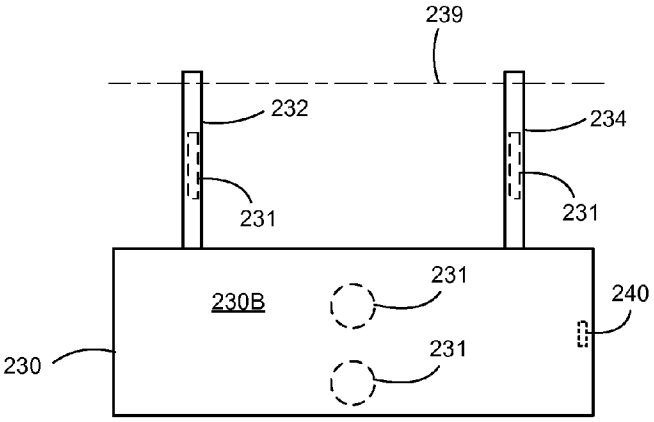
FIG. 7A is a front view of a paddle according to a first example embodiment.
Figure 7B:
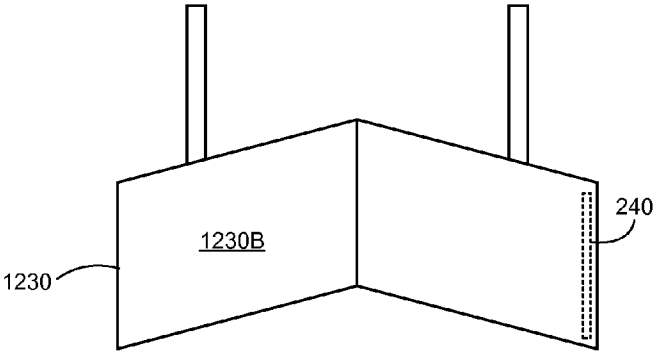
FIG. 7B is a front view of a paddle according to a second example embodiment.
Figure 7C:
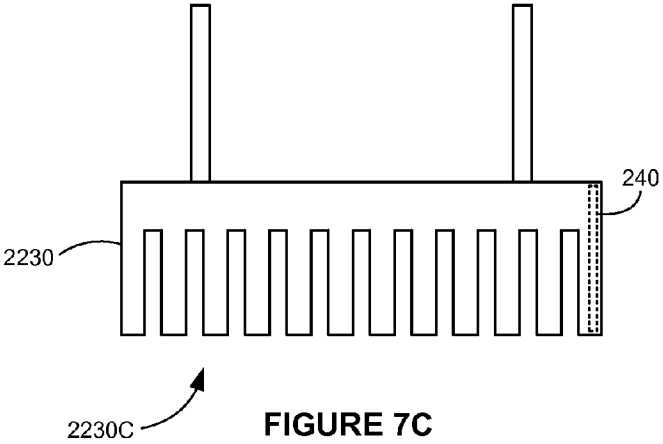
FIG. 7C is a front view of a paddle according to a third example embodiment.
Figure 7D:
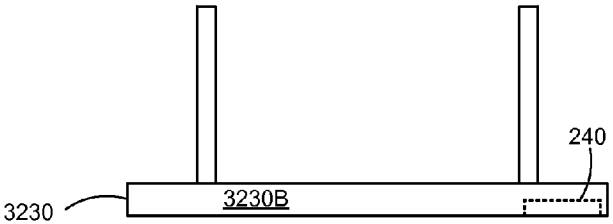
FIG. 7D is a front view of a paddle according to a fourth example embodiment.

Paddle 230 has minimal rotational friction other than its interaction with toner 203 in reservoir 202. As a result, shaft 210 provides radial support for paddle 230 but does not impede the rotational movement of paddle 230. Paddle 230 may be weighted as desired in order to alter its rotational movement. Paddle 230 may take many shapes and sizes as desired. For example, FIG. 7A illustrates the paddle 230 shown in FIGS. 4 and 5. In this embodiment, front face 230B of paddle 230 is substantially planar and normal to the direction of motion of paddle 230 (parallel to shaft 210) to allow front face 230B of paddle 230 to strike toner 203 as paddle 230 falls. In an alternative embodiment, front face 230B of paddle 230 is angled with respect to the direction of motion of paddle 230 (angled with respect to shaft 210). As shown in FIG. 7A, paddle 230 may include one or more weights 231 mounted on paddle 230 and positioned relative to an axis of rotation 239 of paddle 230 as desired to control the rotational movement of paddle 230. FIG. 7B illustrates a V-shaped paddle 1230 having a front face 1230B forming a concave portion of the V-shaped profile for directing toner 203 away from end wall 206 and into outlet port 218. FIG. 7C illustrates a paddle 2230 having a comb portion 2230C for decreasing the friction between paddle 2230 and toner 203. FIG. 7D illustrates a paddle 3230 having a front face 3230B having a smaller surface area as compared with front face 230B of paddle 230 in order to reduce the drag through toner 203.

One or more magnetic sensors 250 positioned on end wall 206 of toner cartridge 200 or positioned in a portion of the image forming device adjacent to end wall 206 when toner cartridge 200 is installed in the image forming device may be used to determine the amount of toner 203 remaining in reservoir 202 by sensing the motion of paddle 230 as shaft 210 rotates. Magnetic sensor(s) 250 may be any suitable device capable of detecting the presence or absence of a magnetic field. For example, magnetic sensor(s) 250 may be a hall-effect sensor, which is a transducer that varies its electrical output in response to a magnetic field. Two magnetic sensors 250A, 250B are depicted in FIGS. 6A-6C. A first magnetic sensor 250A is aligned at or near the lowest center of gravity of paddle 230 to sense the presence of magnet 240 near where paddle 230 oscillates when the toner level in reservoir 202 is low. Accordingly, in one embodiment, magnetic sensor 250A is positioned between about the "5 o'clock" position and about the "7 o'clock" position, such as at about the "6 o'clock" position as shown. An optional second magnetic sensor 250B is positioned between about the "2 o'clock" position and about the "5 o'clock" position. In the example embodiment illustrated, magnetic sensor 250B is positioned at about the "4 o'clock" position. More than two magnetic sensors 250 may also be used as desired.

With reference to FIG. 5, magnetic sensor(s) 250A, 250B may be mounted on end wall 206 (either directly on the outer surface of end wall 206 or indirectly on end wall 206, such as on end cap 208). In this embodiment, magnetic sensor(s) 250A, 250B are in electronic communication with processing circuitry 201 of toner cartridge 200. In the example embodiment illustrated, magnetic sensor(s) 250A, 250B (shown in dashed lines) are mounted on a rear side of an electronic module such as a flex circuit or a printed circuit board (PCB) 201A having processing circuitry 201 of toner cartridge 200 thereon. In the embodiment illustrated, PCB 201A is mounted on an outer surface of end wall 206. PCB 201A contains one or more electrical contacts 201B on a front side of PCB 201A that contact corresponding electrical contact(s) in the image forming device when toner cartridge 200 is installed in the image forming device to facilitate communication with controller 102. Magnetic sensor(s) 250A, 250B may be positioned on other portions of body 204 as desired so long as magnetic sensor(s) 250A, 250B are able to detect the presence of magnet 240 of paddle 230 at a point in the rotational path of paddle 230. For example, in another embodiment, magnet 240 is positioned along the outer radial edge of paddle 230 and magnetic sensor 250A is positioned along the bottom of the outer surface of wall 205 and magnetic sensor 250B is positioned along the side of the outer surface of wall 205. Alternatively, magnetic sensor(s) 250A, 250B may be positioned in a portion of the image forming device adjacent to the outer surface of wall 205 when toner cartridge 200 is installed in the image forming device. PCB 201A may also be positioned on other portions of body 204 as desired.

Magnetic sensor(s) 250A, 250B each provide a digital pulse each time magnetic sensor 250A or 250B senses magnet 240. The width of each digital pulse between a rising edge of the pulse and a falling edge of the pulse (or vice versa) varies depending on the time duration of magnetic sensor 250A or 250B sensing magnet 240. The time duration of magnetic sensor 250A or 250B sensing magnet 240 depends on how quickly magnet 240 passes through a sensing window of magnetic sensor 250A or 250B (i.e., how long magnet 240 is in sufficient proximity for magnetic sensor 250A or 250B to sense magnet 240 as paddle 230 passes the magnetic sensor 250A or 250B). The pulse width patterns from magnetic sensor 250A (and optionally magnetic sensor 250B) for each revolution of shaft 210 may be correlated to the amount of toner 203 in reservoir 202.

When the toner level in reservoir 202 is relatively full, such as depicted in FIG. 6A, the resistance provided by toner 203 in reservoir 202 prevents paddle 230 from reaching magnetic sensor 250A ahead of driving member 217. As a result, when the toner level in reservoir 202 is relatively full, a single digital pulse is generated from magnetic sensor 250A per revolution of shaft 210. The widths of these pulses from magnetic sensor 250A reflect the amount of time it takes for magnet 240 of paddle 230 to pass through the sensing window of magnetic sensor 250A. The amount of time it takes for magnet 240 of paddle 230 to pass through the sensing window of magnetic sensor 250A when reservoir 202 is relatively full of toner 203 depends on the rotational speed of shaft 210 and driving member 217 since toner 203 prevents paddle 230 from falling ahead of driving member 217. The pulses generated when paddle 230 is pushed through the sensing window of magnetic sensor 250A by driving member 217 are referred to herein as "push-through pulses."

As the toner level in reservoir 202 decreases, paddle 230 separates from and falls ahead of driving member 217 until paddle 230 contacts toner 203 which stops the rotational advance of paddle 230. At first, paddle 230 stops ahead of the sensing window of magnetic sensor 250A and remains substantially stationary until driving member 217 catches up with paddle 230 and resumes pushing paddle 230 through its rotational path. Magnet 240 generates a push-through pulse from magnetic sensor 250A when driving member 217 pushes paddle 230 through the sensing window of magnetic sensor 250A.

As the toner level in reservoir 202 continues to decrease, depending on the rotational speed of shaft 210, the toner level may reach a point where paddle 230 falls ahead of driving member 217, strikes toner 203 and briefly enters the sensing window of magnetic sensor 250A before rebounding back out of the sensing window of magnetic sensor 250A as a result of the resistance from toner 203. The brief entrance of paddle 230 into the sensing window of magnetic sensor 250A and rebound back out of the sensing window of magnetic sensor 250A generates what is referred to herein as a "rebound pulse." At slower rotational speeds of shaft 210 (e.g., 25 RPM or less), the rebound pulses typically have a shorter time duration (narrower pulse width) than the push-through pulses. The width of the push-through pulses decreases as the rotational speed of shaft 210 increases because driving member 217 pushes paddle 230 through the sensing window of magnetic sensor 250A faster. The width of the rebound pulses increases as the toner level in reservoir 202 decreases. After paddle 230 rebounds out of the sensing window of magnetic sensor 250A, paddle 230 rests on toner 203 until driving member 217 catches up with paddle 230 pushes paddle 230 through the sensing window of magnetic sensor 250A generating a push-through pulse from magnetic sensor 250A. Accordingly, when a rebound pulse is generated from magnetic sensor 250A, two pulses from magnetic sensor 250A are generated per revolution of shaft 210, the rebound pulse followed by a push-through pulse. The toner level at which magnetic sensor 250A provides a rebound pulse followed by a push-through pulse may be determined empirically for a given architecture of toner cartridge 200 and rotational speed of shaft 210.

As the toner level in reservoir 202 decreases further, depending on the rotational speed of shaft 210, paddle 230 may fall ahead of driving member 217, strike toner 203 and come to rest within the sensing window of magnetic sensor 250A. Paddle 230 then remains in the sensing window of magnetic sensor 250A until driving member 217 catches up and resumes pushing paddle 230. As a result, when paddle remains in the sensing window of magnetic sensor 250A until driving member 217 catches up to paddle 230, magnet 240 generates a single pulse from magnetic sensor 250A per revolution of shaft 210 that is longer than the push-through pulses due to the increased time spent in the sensing window of magnetic sensor 250A. The toner level at which magnetic sensor 250A provides a single pulse that is longer than the push-through pulse may be determined empirically for a given architecture of toner cartridge 200 and rotational speed of shaft 210.

As the toner level in reservoir 202 continues to decrease, depending on the rotational speed of shaft 210, the toner level may reach a point where paddle 230 falls ahead of driving member 217 and swings all the way through the sensing window of magnetic sensor 250A, then swings opposite the rotational direction of shaft 210 back into the sensing window of magnetic sensor 250A and comes to rest within the sensing window of magnetic sensor 250A. Paddle 230 once again remains in the sensing window of magnetic sensor 250A until driving member 217 catches up and resumes pushing paddle 230. The swing of paddle 230 all the way through the sensing window of magnetic sensor 250A generates what is referred to herein as a "swing-through pulse." The swing-through pulses typically have a shorter time duration (narrower pulse width) than the rebound pulses and the push-through pulses. Accordingly, at this toner level, magnet 240 generates two pulses from magnetic sensor 250A per revolution of shaft 210, a swing-through pulse and a pulse that is longer than the push-through pulses due to the increased time spent in the sensing window of magnetic sensor 250A. The toner level at which magnetic sensor 250A provides a swing-through pulse followed by a pulse that is longer than the push-through pulse may be determined empirically for a given architecture of toner cartridge 200 and rotational speed of shaft 210.

As the toner level in reservoir 202 continues to decrease to an empty state, paddle 230 falls ahead of driving member 217 and oscillates back and forth through the sensing window of magnetic sensor 250A until coming to rest in the sensing window of magnetic sensor 250A or until driving member 217 catches up and resumes pushing paddle 230. Accordingly, as the toner level in reservoir 202 nears an empty state, magnet 240 generates three or more pulses from magnetic sensor 250A per revolution of shaft 210 including multiple swing-through pulses (each having a pulse width that is longer than the last due to paddle 230 slowing) followed by a pulse that is longer than the push-through pulses where paddle 230 comes to rest in the sensing window of magnetic sensor 250A due to the increased time spent in the sensing window of magnetic sensor 250A. Alternatively, where paddle 230 oscillates back and forth through the sensing window of magnetic sensor 250A until driving member 217 catches up and resumes pushing paddle 230, the multiple swing-through pulses are followed by a pulse reflecting the amount of time it takes driving member 217 to push paddle 230 through the sensing window of magnetic sensor 250A from wherever driving member 217 catches up with paddle 230. The toner levels at which magnetic sensor 250A provides multiple swing-through pulses may be determined empirically for a given architecture of toner cartridge 200 and rotational speed of shaft 210. The number of passes of paddle 230 past magnetic sensor 250A per revolution of shaft 210 may reach twelve or more when the toner level in reservoir 202 is very low depending on the speed of shaft 210 and the swing period of paddle 230.

Figure 8:
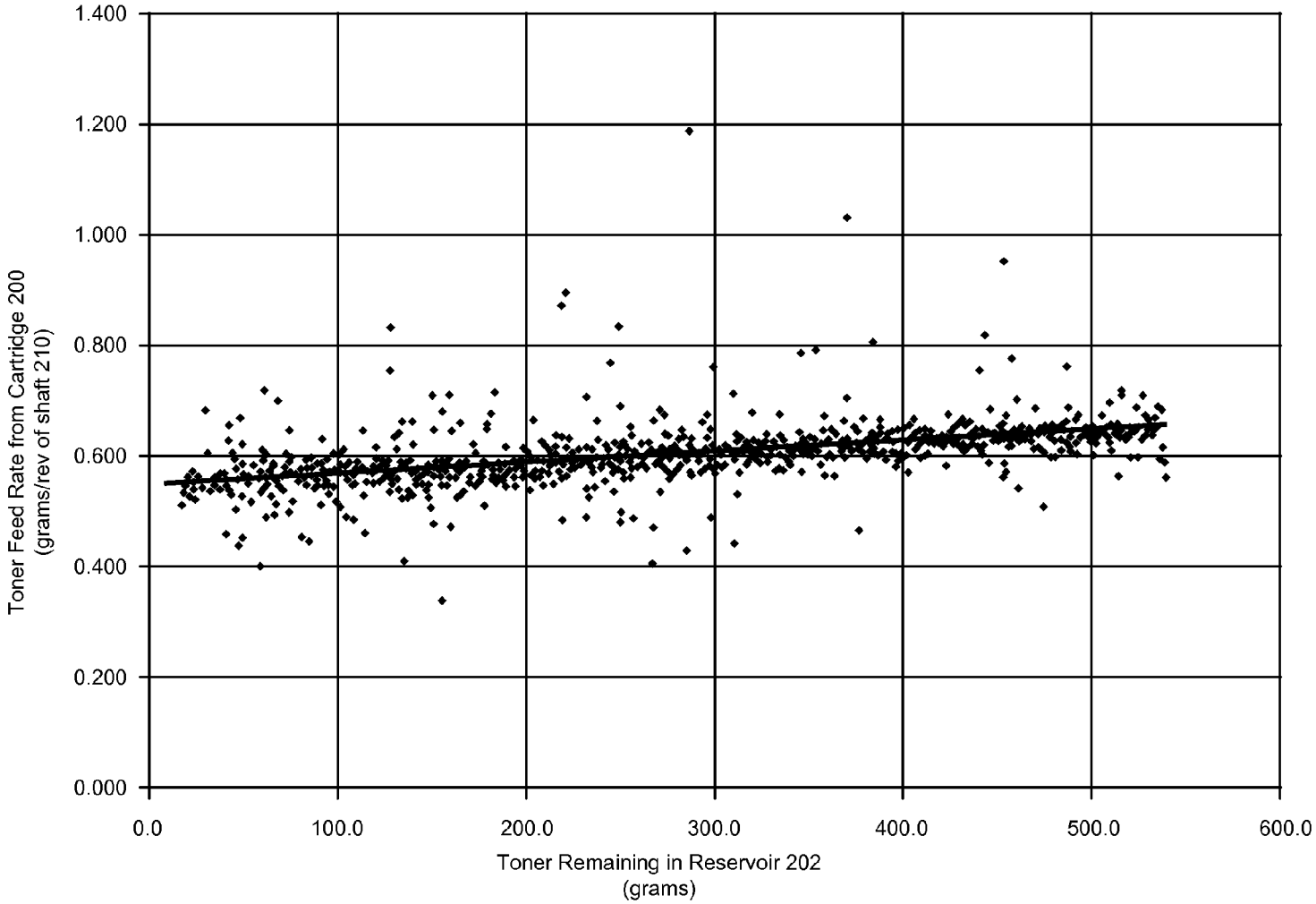
FIG. 8 is a plot of a feed rate of toner exiting a reservoir (in grams per revolution of a shaft in the reservoir) versus an amount of toner remaining in the reservoir (in grams) over the life of one example embodiment of a toner cartridge.

The toner level in reservoir 202 can also be approximated based on an empirically determined feed rate of toner 203 from toner reservoir 202 into the corresponding imaging unit. In one embodiment, it has been observed that the feed rate of toner 203 from reservoir 202 decreases in a nearly linear fashion as the toner level in reservoir 202 decreases with normal variations due to such factors as the properties of toner 203, environmental conditions, and hardware tolerances. For example, FIG. 8 shows a plot of the feed rate of toner exiting reservoir 202 (in grams per revolution of shaft 210) versus the amount of toner remaining in reservoir 202 (in grams) over the life of one example embodiment of toner cartridge 200. The geometry and rotational speed of agitator(s) 216 and the rotatable auger (if present) determine how much toner 203 is fed per revolution of shaft 210. It will be appreciated by those skilled in the art that the use of a rotatable auger to exit toner 203 from reservoir 202 helps control the precision of the feed rate of toner 203 exiting toner cartridge 200. The linear decrease in the feed rate of toner 203 from reservoir 202 is due to the decrease in density of the toner 203 in reservoir 202 as the height of toner 203 decreases. As a result, the toner level in reservoir 202 can be approximated by starting with the initial amount of toner 203 supplied in reservoir 202 and reducing the amount of toner 203 in reservoir 202 per each rotation of shaft 210 based on the empirically determined feed rate. This estimation of the toner level in reservoir 202 may be used until the pulse width patterns from magnetic sensor 250A change from a single push-through pulse per revolution of shaft 210 as discussed above. As the pulse width pattern from magnetic sensor 250A changes, the detection of these changes may be used in combination with the empirically determined feed rate to determine the amount of toner 203 remaining in reservoir 202 as discussed in greater detail below.

In one embodiment, shaft 210 is driven at a relatively low speed such as, for example, about 20-25 RPM or less in order to allow paddle 230 to oscillate past magnetic sensor 250A more than once per revolution of shaft 210 when reservoir 202 has little toner remaining before driving member 217 resumes pushing paddle 230 and to distinguish rebound and swing-through pulses from push-through pulses based on pulse width.

The point at which paddle 230 begins to produce more than a single push-through pulse from pass magnetic sensor 250A per revolution of shaft 210 (the sensing range of paddle 230) and the swing period of paddle 230 depend on the weight of paddle 230 and the radius of gyration of paddle 230 in addition to the rotational speed of shaft 210. As discussed above, paddle 230 may be weighted using one or more optional weights 231 in order to provide a desired weight distribution to define the weight and radius of gyration of paddle 230. Specifically, control of the sensing range by the weight of paddle 230 and the center of gravity of paddle 230 is governed by the initial energy state at the onset of the fall of paddle 230 for a given weight and radius of gyration of paddle 230. As paddle 230 encounters toner 203 in reservoir 202 with each oscillation, this energy is diminished by an amount that is a function of the mass of toner 203 encountered by paddle 230 during that oscillation. This decrease in energy occurs until paddle 230 stops swinging (either through encounters with toner 203 or through other frictions or resistance such as the energy lost in the frictional interface between paddle 230 and shaft 210). In addition to the sensing range, the number of oscillations of paddle 230 that occur when reservoir 202 is empty (the sensing resolution of paddle 230) also depends on the weight distribution of paddle 230.

Figure 9:
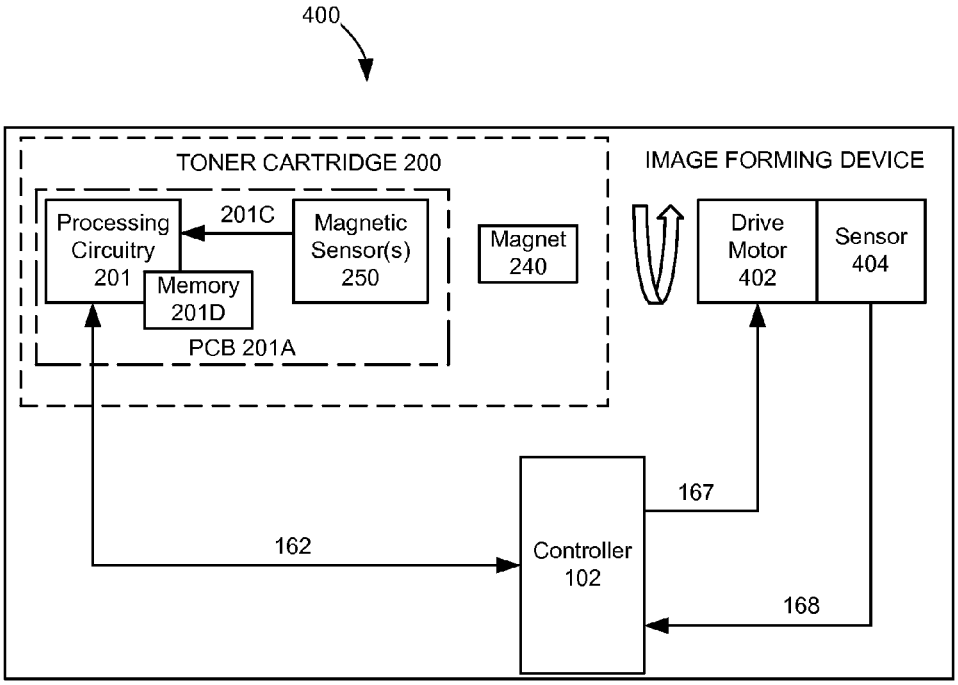
FIG. 9 is a block diagram depiction of a toner level sensing system according to one example embodiment.

FIG. 9 is a block diagram depiction of a toner level sensing system 400 using paddle 230 having magnet 240 and magnetic sensor(s) 250 according to one example embodiment. In this embodiment, magnetic sensor(s) 250 are positioned on body 204 of toner cartridge 200 in position to sense magnet 240 as paddle 230 rotates. Magnetic sensor(s) 250 communicate with processing circuitry 201 of toner cartridge 200 via a communications link 201C. As shown, processing circuitry 201 includes memory 201D. Processing circuitry 201 of toner cartridge 200 communicates with controller 102 via communications link 162. Controller 102 communicates with a drive motor 402 in image forming device 100, 100' via a communications link 167 to selectively power drive motor 402. Drive motor 402 provides rotational motion to drive element 214 when toner cartridge 200 is installed in the image forming device. Drive motor 402 includes an encoder device, such as a conventional encoder wheel mounted on the shaft of drive motor 402, and a corresponding sensor 404, such as a corresponding optical sensor, that detects the rotation of the shaft of drive motor 402. Sensor 404 communicates with controller 102 via a communications link 168 allowing controller 102 to monitor the rotation of drive motor 402.

Figure 10:
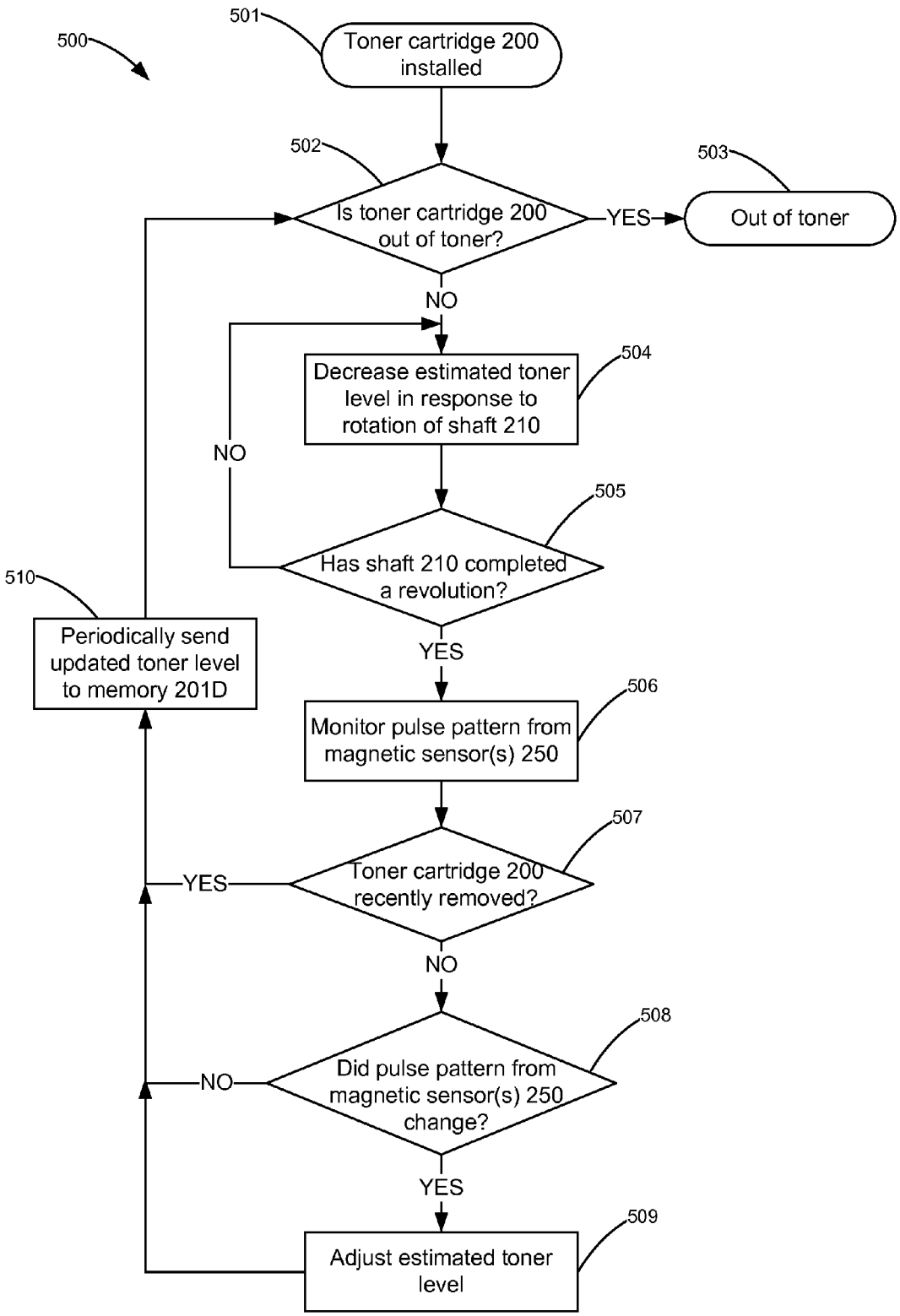
FIG. 10 is a flowchart showing a method for determining an amount of toner remaining in a reservoir of a replaceable unit of the image forming device according to one example embodiment.

FIG. 10 is a flowchart showing a method 500 for determining the amount of toner 203 remaining in reservoir 202 of toner cartridge 200 according to one example embodiment. At step 501, toner cartridge 200 is installed in the image forming device. Toner cartridge 200 may be installed at any point during the life of toner cartridge 200. Accordingly, toner cartridge 200 may be installed with reservoir 202 full of useable toner, out of useable toner or containing a fraction of its maximum amount of usable toner. At step 502, controller 102 (or another processing device in communication with controller 102 such as processing circuitry 201) makes an initial determination of whether reservoir 202 is out of useable toner 203. In one embodiment, memory 201D associated with processing circuitry 201 stores an estimate of the amount of toner 203 remaining in reservoir 202. In this embodiment, the processing device reads memory 201D to determine whether toner cartridge 200 is out of usable toner 203. In other embodiments, a toner sensor in the imaging unit corresponding with toner cartridge 200 may sense whether toner 203 is received by the imaging unit from reservoir 202 upon rotating drive motor 402 to drive shaft 210 with toner cartridge 200 installed. If toner 203 is not received by the imaging unit, the processing device determines that reservoir 202 is out of usable toner 203.

At step 503, in one embodiment, when the processing device determines that reservoir 202 is out of usable toner 203, a message indicating that reservoir 202 is out of usable toner 203 is displayed on user interface 104 and/or display monitor 36. In some embodiments, when the processing device determines that the reservoir 202 of a particular toner cartridge 200 is out of usable toner 203, the image forming device may shut down printing of the color of toner carried by that particular toner cartridge 200 (or printing of any color) until the empty toner cartridge 200 is replaced in order to prevent damage to downstream components in the imaging unit corresponding to the toner cartridge 200.

At step 504, if reservoir 202 contains usable toner 203, the processing device decreases the estimate of the amount of toner remaining in reservoir 202 in response to the rotation of shaft 210. The estimate of the amount of toner remaining in reservoir 202 may be expressed directly by an amount of toner, such as a mass of toner, or indirectly using a measure that corresponds with the amount of toner 203 remaining in reservoir 202 such as, for example, a number of revolutions of shaft 210, a number of revolutions of drive motor 402, a number of encoder windows sensed by sensor 404, a number of toner addition cycles, a number of pages printed, a number of pels printed, etc. In one embodiment, the estimate of the amount of toner 203 remaining is decreased according to the empirically determined feed rate of toner 203 from toner reservoir 202 into the corresponding imaging unit. The feed rate of toner 203 from reservoir 202 may be expressed, for example, in terms of the mass of toner fed per revolution of shaft 210, per revolution of drive motor 402, per toner addition cycle, etc.

At step 505, the processing device may monitor whether shaft 210 has completed a revolution, which may be determined using a variety of methods. In one embodiment, a revolution of shaft 210 is determined using an encoder wheel and corresponding sensor 404 on drive motor 402. Specifically, the total number of encoder windows making up one revolution of the encoder wheel of drive motor 402 may be adjusted based on the gear ratio between drive motor 402 and shaft 210 in order to determine the number of encoder windows that make up one revolution of shaft 210. In another embodiment, a revolution of shaft 210 is determined using a flag on drive element 214 where shaft 210 has a 1:1 gear ratio with drive element 214 or on another gear or coupler on body 204 having a 1:1 gear ratio with shaft 210 that passes an optical sensor once per revolution of shaft 210. Similarly, where an encoder wheel and corresponding sensor 404 on drive motor 402 are used to detect a revolution of shaft 210, a flag on drive motor 402 that passes an optical sensor once per revolution of drive motor 402 may be used to confirm that the encoder wheel hasn't drifted backwards causing an encoder window to be counted more than once per revolution of drive motor 402. In another embodiment, magnetic sensor 250B is used to determine that shaft 210 has completed a revolution. Specifically, a revolution of shaft 210 is detected when the time between magnetic sensor 250A sensing magnet 240 and magnetic sensor 250B sensing magnet 240 (where magnetic sensor 250B is positioned less than 180 degrees ahead of magnetic sensor 250A in the direction of rotation of shaft 210) exceeds a predetermined threshold (e.g., half the rotational period of shaft 210) indicating that paddle 230 has traveled greater than 180 degrees from magnetic sensor 250A to magnetic sensor 250B as opposed to oscillating opposite the rotational direction of shaft 210 less than 180 degrees from magnetic sensor 250A to magnetic sensor 250B. In another embodiment, magnetic sensor 250A is used to determine that shaft 210 has completed a revolution. Specifically, a revolution of shaft 210 is detected when the time between two successive instances of magnetic sensor 250A sensing magnet 240 exceeds a predetermined threshold (e.g., half the rotational period of shaft 210) indicating that paddle 230 has traveled 360 degrees to return to magnetic sensor 250A as opposed to oscillating in a pendulum manner back and forth past magnetic sensor 250A during a single revolution of shaft 210. Those skilled in the art will appreciate that other suitable methods may be used to determine whether shaft 210 has completed a revolution.

At step 506, the processing device monitors the digital pulse width pattern from magnetic sensor 250A. The pulse width pattern from magnetic sensor 250A includes the relative widths of the digital pulses from magnetic sensor 250A in sequence. The pulse width pattern from magnetic sensor 250A may also include the number of pulses from magnetic sensor 250A per revolution of shaft 210. The pulse width pattern may also include the timing between the pulses from magnetic sensor 250A.

At step 507, the processing device may determine whether toner cartridge 200 was recently removed from the image forming device, which may be detected, for example, by a break in the contact between electrical contacts 201B and the corresponding electrical contacts in the image forming device or by using a conventional mechanical flag sensor or optical sensor that detects the presence or absence of toner cartridge 200 in the image forming device. When toner cartridge 200 is removed from the image forming device, toner 203 may shift to a portion of reservoir 202 away from paddle 230. As a result, when toner cartridge 200 is reinserted into the image forming device and shaft 210 is rotated, the uneven distribution of toner 203 in reservoir 202 and absence of toner 203 near paddle 230 may cause paddle 230 to move differently than it otherwise would given the amount of toner 203 still remaining in reservoir 202 if toner 203 was more evenly distributed in reservoir 202. As a result, it may be desirable to ignore the data from magnetic sensor 250A for a predetermined number of rotations of shaft 210 after toner cartridge 200 is reinserted into the image forming device in order to allow the toner 203 in reservoir 202 to distribute more evenly. Otherwise the movement of paddle 230 due to an uneven toner distribution may be misinterpreted leading to an incorrect toner level determination.

At step 508, if toner cartridge 200 has not been removed from the image forming device recently, the processing device determines whether the pulse width pattern from magnetic sensor 250A has changed. For example, as discussed above, a single push-through pulse per revolution of shaft 210 may change to two pulses per revolution of shaft 210, e.g., a rebound pulse followed by a push-through pulse, and so on. As discussed above, the toner levels at which these changes in the pulse width pattern from magnetic sensor 250A occur may be determined empirically for a given architecture of toner cartridge 200 and rotational speed of shaft 210. In one embodiment, determining whether the pulse width pattern from magnetic sensor 250A has changed includes determining whether the pulse width pattern from magnetic sensor 250A has changed for, as examples, two out of the last three revolutions of shaft 210, three out of the last four revolutions of shaft 210, three out of the last five revolutions of shaft 210, etc. in order to account for normal variations which may cause paddle 230 to behave differently than expected in any given rotation of shaft 210.

At step 509, when the pulse width pattern from magnetic sensor 250A changes, the processing device adjusts the estimate of the amount of toner 203 remaining in reservoir 202 based on an empirically determined amount of toner 203 corresponding with the most recent pulse width pattern from magnetic sensor 250A. In one embodiment, when the pulse width pattern from magnetic sensor 250A changes, the processing device substitutes the empirically determined amount of toner 203 corresponding with the most recent pulse width pattern from magnetic sensor 250A for the present estimate of the amount of toner 203 remaining. For example, where the pulse width pattern changes from a single push-through pulse per revolution of shaft 210 to two pulses per revolution of shaft 210, e.g., a rebound pulse followed by a push-through pulse, the processing device may substitute an empirically determined amount of toner 203 corresponding with the detection of a rebound pulse followed by a push-through pulse per revolution of shaft 210 for the present estimate of the amount of toner 203 remaining. The processing device then decreases the revised estimate of the amount of toner 203 remaining as discussed above in step 504 until the pulse width pattern changes again at which point the processing device once again adjusts the estimate of the amount of toner 203 remaining. In another embodiment, when the pulse width pattern from magnetic sensor 250A changes, the processing device recalculates the estimate of the amount of toner 203 remaining by weighting both the empirically determined amount of toner 203 corresponding with the most recent pulse width pattern from magnetic sensor 250A and the present estimate of the amount of toner 203 remaining. For example, where the pulse width pattern changes from a single push-through pulse per revolution of shaft 210 to two pulses per revolution of shaft 210, e.g., a rebound pulse followed by a push-through pulse, the processing device may give fifty percent weight (or any other suitable weight) to an empirically determined amount of toner 203 corresponding the detection of a rebound pulse followed by a push-through pulse per revolution of shaft 210 and fifty percent weight (or any other suitable weight) to the present estimate of the amount of toner 203 remaining to determine the new estimate of the amount of toner 203 remaining in reservoir 202. The processing device then decreases the revised estimate of the amount of toner 203 remaining as discussed above in step 504 until the pulse width pattern changes again at which point the processing device once again adjusts the estimate of the amount of toner 203 remaining.

At step 510, the processing device periodically sends the current estimate of the amount of toner 203 remaining in reservoir 202 to processing circuitry 201 for storage in memory 201D associated with processing circuitry 201. In this manner, the estimate of the amount of toner 203 remaining in reservoir 202 travels with toner cartridge 200 if toner cartridge 200 is removed and inserted into a different image forming device so that the new image forming device will be able to continue to estimate the amount of toner 203 remaining in reservoir 202 accurately. Further, memory 201D associated with processing circuitry 201 also serves a storage backup for the estimate of the amount of toner 203 remaining in case the power to the image forming device that toner cartridge 200 is installed in is interrupted.

Back at step 502, the processing device determines whether reservoir 202 is out of useable toner 203 based on the most recent estimate of toner 203 remaining as determined at step 504 and adjusted periodically at step 509.

In one embodiment, the processing device also uses data from magnetic sensor 250B to adjust the estimate of the amount of toner 203 remaining in reservoir 202 before the pulse width pattern from magnetic sensor 250A changes from a single push-through pulse per revolution of shaft 210. In this embodiment, at step 506, the processing device also determines the pulse width pattern from magnetic sensor 250B. In this embodiment, in addition to determining whether the pulse width pattern from magnetic sensor 250A has changed, the processing device also determines whether the pulse width pattern from magnetic sensor 250B has changed at step 508. For example, in one embodiment, this includes determining whether the pulse width pattern from magnetic sensor 250B has changed for, as examples, two out of the last three revolutions of shaft 210, three out of the last four revolutions of shaft 210, three out of the last five revolutions of shaft 210, etc. in order to account for normal variations which may cause paddle 230 to pass magnetic sensor 250B faster or slower than expected in any given rotation of shaft 210. At step 509, when the pulse width pattern from magnetic sensor 250B changes, the processing device adjusts the estimate of the amount of toner 203 remaining in reservoir 202 based on an empirically determined amount of toner 203 corresponding with the most recent pulse width pattern from magnetic sensor 250B.

With reference to FIG. 6A, when reservoir 202 is relatively full of toner 203, paddle 230 moves at the same speed as driving member 217 due to the resistance provided by toner 203. As a result, when reservoir 202 is relatively full of toner 203, a single push-through pulse is generated from magnetic sensor 250B per revolution of shaft 210 as discussed above with respect to magnetic sensor 250A. With reference to FIG. 6B, as the toner level in reservoir 202 decreases, the toner level reaches a point where paddle 230 falls forward ahead of driving member 217 after paddle 230 passes the "12 o'clock" position and rests on toner 203 in sufficient proximity for magnetic sensor 250B to sense magnet 240 (i.e., within the sensing window of magnetic sensor 250B). At this point, a single pulse that is longer than the push-through pulse for magnetic sensor 250B is generated from magnetic sensor 250B reflecting the amount of time that paddle 230 rests on toner 203 in reservoir 202 until driving member 217 catches up with paddle 230 and resumes pushing paddle 230. As the toner level continues to decrease, the toner level reaches a point where paddle 230 falls forward ahead of driving member 217 and passes through the sensing window of magnetic sensor 250B before resting on toner 203 past the range where magnetic sensor 250B can sense magnet 240. At this point, a single swing-through pulse is generated from magnetic sensor 250B per revolution of shaft 210 that is shorter than the push-through pulse of magnetic sensor 250B reflecting the rotational speed of paddle 230 as paddle 230 falls ahead of driving member 217 through the sensing window of magnetic sensor 250B.

The toner level at which magnetic sensor 250B provides a single swing-through pulse per revolution of shaft 210 may be determined empirically for a given architecture of toner cartridge 200 and rotational speed of shaft 210. In one embodiment, at step 509, the processing device adjusts the estimate of the amount of toner 203 remaining in reservoir 202 when the width of the digital pulse from magnetic sensor 250B falls below a predetermined threshold (indicating a swing-through pulse) based on the empirically determined toner level. As discussed above, the processing device may substitute the empirically determined amount of toner 203 for the present estimate of the amount of toner 203 remaining or the processing device may recalculate the amount of toner 203 remaining by weighting both the empirically determined amount of toner 203 corresponding to the decrease of the width of the digital pulse from magnetic sensor 250B and the present estimate of the amount of toner 203 remaining.

Accordingly, an amount of toner remaining in a reservoir may be determined by sensing the rotational motion of a falling paddle, such as paddle 230, mounted on a rotatable shaft and rotatable independent of the shaft within the reservoir. Because the motion of paddle 230 is detectable by a sensor outside of reservoir 202, paddle 230 may be provided without an electrical or mechanical connection to the outside of body 204 (other than shaft 210). This avoids the need to seal an additional connection into reservoir 202, which could be susceptible to leakage. Because no sealing of paddle 230 is required, no sealing friction exists that could alter the motion of paddle 230. Further, positioning the magnetic sensor(s) outside of reservoir 202 reduces the risk of toner contamination, which could damage the sensor(s). The magnetic sensor(s) may also be used to detect the installation of toner cartridge 200 in the image forming device and to confirm that shaft 210 is rotating properly thereby eliminating the need for additional sensors to perform these functions.

While the example embodiments illustrated show magnet 240 positioned on the body of paddle 230 in line with front face 230B of paddle 230 and the center of gravity of paddle 230, it will be appreciated that magnet 240 may be offset angularly from paddle 230 as desired. For example, magnet 240 may be positioned on an arm or other form of extension that is angled with respect to paddle 230 and connected to paddle 230 to rotate with paddle 230. For example, where two magnetic sensors 250A, 250B are used, if magnet 240 is offset 90 degrees ahead of paddle 230, magnetic sensor 250A is positioned between about the "8 o'clock" position and about the "10 o'clock" position, such as at about the "9 o'clock" position, to detect when paddle 230 is at or near its lowest center of gravity where paddle 230 oscillates and magnetic sensor 250B may be positioned between about the "5 o'clock" position and about the "8 o'clock" position, such as at about the "7 o'clock" position, to detect when paddle 230 falls away from driving member 217. Similarly, where one magnetic sensor 250A is used, if magnet 240 is offset 180 degrees from paddle 230, magnetic sensor 250A is positioned between about the "11 o'clock" position and about the "1 o'clock" position, such as at about the "12 o'clock" position, to detect when paddle 230 is at or near its lowest center of gravity where paddle 230 oscillates. Further, instead of using two magnetic sensors 250A, 250B to detect the motion of one magnet 240, it will be appreciated that a single magnetic sensor 250 may detect the motion of a pair of angularly offset magnets 240. In this embodiment, one or both of the magnets 240 may be positioned on an arm or extension connected to paddle 230 to rotate with paddle 230.

The shape, architecture and configuration of toner cartridge 200 shown in FIGS. 4 and 5 are meant to serve as examples and are not intended to be limiting. For instance, although the example image forming device discussed above includes a pair of mating replaceable units in the form of toner cartridge 200 and imaging unit 300, it will be appreciated that the replaceable unit(s) of the image forming device may employ any suitable configuration as desired. For example, in one embodiment, the main toner supply for the image forming device, toner adder roll 304, developer roll 306 and photoconductive drum 310 are housed in one replaceable unit. In another embodiment, the main toner supply for the image forming device, toner adder roll 304 and developer roll 306 are provided in a first replaceable unit and photoconductive drum 310 is provided in a second replaceable unit.

Although the example embodiments discussed above utilize a falling paddle in the reservoir of the toner cartridge, it will be appreciated that a falling paddle, such as paddle 230, having a magnet may be used to determine the toner level in any reservoir or sump storing toner in the image forming device such as, for example, a reservoir of the imaging unit or a storage area for waste toner. Further, although the example embodiments discussed above discuss a system for determining a toner level, it will be appreciated that this system and the methods discussed herein may be used to determine the level of a particulate material other than toner such as, for example, grain, seed, flour, sugar, salt, etc.

Although the examples above discuss the use of one or two magnetic sensors, it will be appreciated that more than two magnetic sensors may be used as desired in order to obtain more information regarding the movement of the falling paddle having the magnet. Further, while the examples discuss sensing a magnet using a magnetic sensor, in another embodiment, an inductive sensor, such as an eddy current sensor, or a capacitive sensor is used instead of a magnetic sensor. In this embodiment, the falling paddle includes an electrically conductive element detectable by the inductive or capacitive sensor. As discussed above with respect to magnet 240, the metallic element may be attached to the falling paddle by a friction fit, adhesive, fastener(s), etc. or the falling paddle may be composed of a metallic material or the metallic element may be positioned on an arm or extension that is rotatable with the falling paddle. In another alternative, the falling paddle includes a shaft that extends to an outer portion of body 204, such as through wall 206 or 207. An encoder wheel or other form of encoder device is attached or formed on the portion of the shaft of the falling paddle that is outside reservoir 202. A code reader, such as an infrared sensor, is positioned to sense the motion of the encoder device (and therefore the motion of the falling paddle) and in communication with controller 102 or another processor that analyzes the motion of the falling paddle in order to determine the amount of toner remaining in reservoir 202.

The foregoing description illustrates various aspects of the present disclosure. It is not intended to be exhaustive. Rather, it is chosen to illustrate the principles of the present disclosure and its practical application to enable one of ordinary skill in the art to utilize the present disclosure, including its various modifications that naturally follow. All modifications and variations are contemplated within the scope of the present disclosure as determined by the appended claims. Relatively apparent modifications include combining one or more features of various embodiments with features of other embodiments.

The invention claimed is:

1. A method for estimating an amount of toner remaining in a reservoir of a replaceable unit or an image forming device, the method comprising:

rotating a shaft positioned in the reservoir and measuring an amount of revolution of the shaft;

pushing by the rotation of the shaft a paddle mounted on the shaft and free to fall ahead of the rotation of the shaft;

decreasing an estimate of the amount of toner remaining in the reservoir based on the measured amount of revolution of the shaft;

sensing a magnetic field of a magnet connected to the paddle by a first magnetic sensor when the paddle is near a lowest center of gravity of the paddle;

generating a digital pulse having a width in response to the sensing of the magnetic field of the magnet by the first magnetic sensor, the width being a function of a time duration of the first magnetic sensor sensing the magnetic field of the magnet;

monitoring whether a pattern of widths of digital pulses generated in response to the sensing of the magnetic field of the magnet by the first magnetic sensor changes; and adjusting the estimate of the amount of toner remaining in the reservoir when the pattern of widths of digital pulses generated in response to the sensing of the magnetic field of the magnet by the first magnetic sensor changes.

2. The method of claim 1, wherein:

decreasing the estimate of the amount of toner remaining in the reservoir based on the measured amount of revolution of the shaft includes decreasing an estimate of an amount of revolution of the shaft until the reservoir will run out of usable toner based on the measured amount of revolution of the shaft; and adjusting the estimate of the amount of toner remaining in the reservoir when the pattern of widths of digital pulses generated in response to the sensing of the magnetic field of the magnet by the first magnetic sensor changes includes adjusting the estimate of the amount of revolution of the shaft until the reservoir will run out of usable toner when to the pattern of widths of digital pulses generated in response to the sensing of the magnetic field of the magnet by the first magnetic sensor changes.

3. The method of claim 2, wherein:

decreasing the estimate of the amount of revolution of the shaft until the reservoir will run out of usable toner includes decreasing an estimate of an amount of revolution of a drive motor providing rotational motion to the shaft until the reservoir will run out of usable toner, and adjusting the estimate of the amount of revolution of the shaft until the reservoir will run out of usable toner when the pattern of widths of digital pulses generated in response to the sensing of the magnetic field of the magnet by the first magnetic sensor changes includes adjusting the estimate of the amount of revolution of the drive motor providing rotational motion to the shaft until the reservoir will run out of usable toner when the pattern of widths of digital pulses generated in response to the sensing of the magnetic field of the magnet by the first magnetic sensor changes.

4. The method of claim 1, wherein decreasing the estimate of the amount of toner remaining in the reservoir based on the measured amount of revolution of the shaft includes decreasing the estimate of the amount of toner remaining in the reservoir based on an empirically determined feed rate of toner from the reservoir.

5. The method of claim 1, further comprising determining whether the replaceable unit was recently removed from the image forming device and if the replaceable unit was recently removed from the image forming device, not adjusting the estimate of the amount of toner remaining in the reservoir when the pattern of widths of digital pulses generated in response to the sensing of the magnetic field of the magnet by the first magnetic sensor changes for a predetermined number of revolutions of the shaft after the replaceable unit was removed from the image forming device.

6. The method of claim 1, wherein adjusting the estimate of the amount of toner remaining in the reservoir includes calculating a new estimate of the amount of toner remaining in the reservoir giving weight to a present estimate of the amount of toner remaining in the reservoir and giving weight to an estimate of the amount of toner remaining in the reservoir corresponding to a present pattern of widths of digital pulses generated in response to the sensing of the magnetic field of the magnet by the first magnetic sensor.

7. The method of claim 1, further comprising:

sensing the magnetic field of the magnet connected to the paddle by a second magnetic sensor positioned less than 180 degrees ahead of the first magnetic sensor with respect to the rotational direction of the shaft;

generating a digital pulse having a width in response to the sensing of the magnetic field of the magnet by the second magnetic sensor, the width being a function of a time duration of the second magnetic sensor sensing the magnetic field of the magnet;

monitoring whether a pattern of widths of digital pulses generated in response to the sensing of the magnetic field of the magnet by the second magnetic sensor changes; and adjusting the estimate of the amount of toner remaining in the reservoir when the pattern of widths of digital pulses generated in response to the sensing of the magnetic field of the magnet by the second magnetic sensor changes.

8. The method of claim 7, wherein:

monitoring whether the pattern of widths of digital pulses generated in response to the sensing of the magnetic field of the magnet by the second magnetic sensor changes includes monitoring whether the widths of digital pulses generated in response to the sensing of the magnetic field of the magnet by the second magnetic sensor fall below a predetermined threshold; and adjusting the estimate of the amount of toner remaining in the reservoir when the pattern of widths of digital pulses generated in response to the sensing of the magnetic field of the magnet by the second magnetic sensor changes includes adjusting the estimate of the amount of toner remaining in the reservoir when the widths of digital pulses generated in response to the sensing of the magnetic field of the magnet by the second magnetic sensor fall below the predetermined threshold.

9. An electrophotographic image forming device, comprising:

a drive motor, a replaceable unit having:

a reservoir for storing toner;

a rotatable shaft positioned within the reservoir;

a paddle mounted on the shaft and free to fall ahead of the rotation of the shaft;

a magnet connected to the paddle; and a drive element positioned to receive rotational force from the drive motor when the replaceable unit is installed in the image forming device and operatively connected to the shaft to rotate the shaft upon receiving the rotational force from the drive motor, a first magnetic sensor positioned to sense a magnetic field of the magnet when the paddle passes near the lowest center of gravity of the paddle, the first magnetic sensor generates a digital pulse when the first magnetic sensor senses the magnetic field of the magnet, the width of each digital pulse is a function of a time duration of the first magnetic sensor sensing the magnetic field of the magnet; and a processor in electronic communication with the sensor and programmed to: measure an amount of revolution of the shaft;

decrease an estimate of the amount of toner remaining in the reservoir based on the measured amount of revolution of the shaft;

monitor whether a pattern of widths of digital pulses generated from the first magnetic sensor when the first magnetic sensor senses the magnetic field of the magnet changes; and adjust the estimate of the amount of toner remaining in the reservoir when the pattern of widths of digital pulses generated from the first magnetic sensor changes.

10. The electrophotographic image forming device of claim 9, wherein to decrease the estimate of the amount of toner remaining in the reservoir based on the measured amount of revolution of the shaft the processor is programmed to decrease the estimate of the amount of toner remaining in the reservoir based on an empirically determined feed rate of toner from the reservoir.

11. The electrophotographic image forming device of claim 9, further comprising a second magnetic sensor positioned less than 180 degrees ahead of the first magnetic sensor with respect to the rotational direction of the shaft and positioned to sense the magnetic field of the magnet, the second magnetic sensor generates a digital pulse when the second magnetic sensor senses the magnetic field of the magnet, the width of each digital pulse from the second magnetic sensor is a function of a time duration of the second magnetic sensor sensing the magnetic field of the magnet, wherein the processor is programmed to monitor whether a pattern of widths of digital pulses generated from the second magnetic sensor when the second magnetic sensor senses the magnetic field of the magnet changes and to adjust the estimate of the amount of toner remaining in the reservoir when the pattern of widths of digital pulses generated from the second magnetic sensor changes.

12. A controller for use with an image forming device for estimating an amount of toner remaining in a reservoir of a replaceable unit of the image forming device, comprising:

the controller programmed:

to measure an amount of revolution of a shaft in the reservoir of the replaceable unit;

to decrease an estimate of the amount of toner remaining in the reservoir based on the measured amount of revolution of the shaft;

to monitor whether a pattern of widths of digital pulses generated from a magnetic sensor when the magnetic sensor senses a magnetic field of a magnet connected to a paddle mounted on the shaft in the reservoir when the paddle is near a lowest center of gravity of the paddle changes, the widths of the digital pulses are a function of a time duration of the magnetic sensor sensing the magnetic field of the magnet; and to adjust the estimate of the amount of toner remaining in the reservoir when the pattern of widths of digital pulses generated from the magnetic sensor changes.

13. The controller of claim 12, wherein to decrease the estimate of the amount of toner remaining in the reservoir based on the measured amount of revolution of the shaft the controller is programmed to decrease the estimate of the amount of toner remaining in the reservoir based on an empirically determined feed rate of toner from the reservoir.

* * * * *